US008095298B2

(12) United States Patent
Nakamura et al.

(10) Patent No.: US 8,095,298 B2
(45) Date of Patent: Jan. 10, 2012

(54) VARIABLE VALVE ACTUATION SYSTEM OF INTERNAL COMBUSTION ENGINE

(75) Inventors: Makoto Nakamura, Kanagawa (JP); Seinosuke Hara, Kanagawa (JP)

(73) Assignee: Hitachi, Ltd., Tokyo (JP)

( * ) Notice: Subject to any disclaimer, the term of this patent is extended or adjusted under 35 U.S.C. 154(b) by 185 days.

(21) Appl. No.: 12/685,789

(22) Filed: Jan. 12, 2010

(65) Prior Publication Data

US 2010/0108027 A1 May 6, 2010

Related U.S. Application Data

(62) Division of application No. 11/598,786, filed on Nov. 14, 2006, now Pat. No. 7,703,424.

(30) Foreign Application Priority Data

Dec. 28, 2005 (JP) ..... 2005-377011
Sep. 13, 2006 (JP) ..... 2006-247523

(51) Int. Cl.
*F02D 13/04* (2006.01)
*F02D 41/00* (2006.01)
*G06F 19/00* (2011.01)
*F01L 1/34* (2006.01)

(52) U.S. Cl. ..... 701/112; 123/90.17; 123/179.4; 701/113

(58) Field of Classification Search ..... 123/90.11, 123/90.15–90.18, 179.3, 179.4, 322, 345–348, 123/513; 701/103–105, 110, 112–115
See application file for complete search history.

(56) References Cited

U.S. PATENT DOCUMENTS 6,408,806 B2 * 6/2002 Sugiyama et al. ..... 123/90.15
6,445,982 B1 9/2002 Swales et al.
6,805,081 B2 10/2004 Watanabe et al.
7,032,381 B2 4/2006 Shiraishi et al.
7,036,471 B2 * 5/2006 Minami et al. ..... 123/90.15
7,059,297 B2 * 6/2006 Kataoka et al. ..... 123/322
7,146,966 B2 12/2006 Nakamura
7,159,555 B2 1/2007 Nohara et al.
7,168,410 B2 * 1/2007 Kato et al. ..... 123/339.15
7,191,746 B2 3/2007 Nakamura (Continued)

FOREIGN PATENT DOCUMENTS

CN 1704575 A 12/2005

(Continued)

OTHER PUBLICATIONS

Makoto Nakamura, U.S. PTO Office Action, U.S. Appl. No. 11/598,786, filed Nov. 24, 2008, 13 pgs.

(Continued)

*Primary Examiner* — Willis Wolfe, Jr.
*Assistant Examiner* — Johnny Hoang
(74) *Attorney, Agent, or Firm* — Foley & Lardner LLP

(57) ABSTRACT

In a variable valve actuation system of an internal combustion engine employing a variable valve actuator capable of variably adjusting at least intake valve closure timing depending on engine operating conditions, a processor of a control unit is programmed to phase-advance the intake valve closure timing to a predetermined timing value after a piston top dead center position and before a piston bottom dead center position on intake stroke during at least one of an engine starting period and an engine stopping period. The variable valve actuator includes a biasing device by which the intake valve closure timing is permanently biased toward the predetermined timing value.

3 Claims, 11 Drawing Sheets

U.S. PATENT DOCUMENTS

| | | | | |
|---|---|---|---|---|
| 7,267,104 | B2 | 9/2007 | Watanabe et al. | |
| 7,769,529 | B2 * | 8/2010 | Inoue et al. | 701/105 |
| 7,813,864 | B2 * | 10/2010 | Kawai et al. | 701/103 |
| 2001/0050066 | A1 * | 12/2001 | Sugiyama et al. | 123/90.17 |
| 2003/0062009 | A1 * | 4/2003 | Nohara et al. | 123/90.16 |
| 2004/0011313 | A1 * | 1/2004 | Kawamura et al. | 123/90.16 |
| 2005/0139183 | A1 | 6/2005 | Nohara et al. | |

FOREIGN PATENT DOCUMENTS

| | | | |
|---|---|---|---|
| JP | 07-034820 | A | 2/1995 |
| JP | 10-227236 | | 8/1998 |
| JP | 2002-061522 | A | 2/2002 |
| JP | 2002-097971 | A | 4/2002 |
| JP | 2003-172112 | | 6/2003 |
| JP | 2004-011537 | | 1/2004 |

OTHER PUBLICATIONS

Makoto Nakamura, U.S. PTO Office Action, U.S. Appl. No. 11/598,786, filed Mar. 25, 2009, 8 pgs.

Makoto Nakamura, U.S. PTO Notice of Allowance, U.S. Appl. No. 11/598,786, filed Oct. 6, 2009, 4 pgs.

* cited by examiner

VARIABLE VALVE ACTUATION SYSTEM OF INTERNAL COMBUSTION ENGINE

CROSS-REFERENCE TO RELATED PATENT APPLICATIONS

This application is a Divisional of U.S. application Ser. No. 11/598,786, filed Nov. 14, 2006, which is based upon and claims the benefit of priority from prior Japanese Patent Applications No. 2005-377011, filed Dec. 28, 2005, and No. 2006-247523, filed Sep. 13, 2006, the entire contents of all of which are incorporated herein by reference in their entirety.

TECHNICAL FIELD

The present invention relates to a variable valve actuation system of an internal combustion engine, and specifically to a system capable of suppressing or reducing noise and vibrations produced during an engine starting period such as during an early stage of cranking.

BACKGROUND ART

In recent years, there have been proposed and developed various variable valve actuation systems capable of variably adjusting an engine valve timing depending on operating conditions of an internal combustion engine. One such variable valve actuation system has been disclosed in Japanese Patent Provisional Publication No. 10-227236 (hereinafter is referred to as "JP10-227236"). The variable valve actuation system disclosed in JP10-227236 is comprised of a so-called rotary vane type valve timing control (VTC) system. In such a rotary vane type VTC system, working fluid pressure is supplied selectively into either one of phase-advance and phase-retard chambers defined in a rotary-vane housing and working fluid pressure is exhausted from the other, in such a manner as to rotate a vane, fixedly connected to a camshaft, in either one of normal-rotational and reverse-rotational directions, thus variably controlling intake valve timing (intake valve open timing and intake valve closure timing) depending on engine operating conditions.

When starting a cold engine, whose coolant temperature is low, an engine crankshaft is rotated by a predetermined crank angle in a reverse-rotational direction for starting the engine with a vane shifted to its maximum phase-advance position. This is because an effective compression ratio becomes high when starting the engine with the vane kept at the maximum phase-advance position, and thus the engine startability can be improved during a cranking period of cold starting operation.

Under a condition where the engine has been warmed up and the coolant temperature becomes adequately high, the vane is shifted to its maximum phase-retard position according to normal cranking operation that the crankshaft is cranked in the normal-rotational direction. This is because an effective compression ratio becomes low when starting the engine with the vane kept at the maximum phase-retard position. That is, by way of such decompression, it is possible to attenuate or reduce noise and vibrations when starting with a warm engine.

SUMMARY OF THE INVENTION

However, in the variable valve actuation system disclosed in JP10-227236, if the engine operating condition is warm (i.e., high coolant temperature), the engine is cranked and started at intake valve closure timing phase-retarded from a piston bottom dead center (BDC) position on intake stroke and corresponding to the maximum phase-retard position. Thus, on the one hand, it is possible to reduce noise and vibrations by way of the decompression effect. On the other hand, an intake-valve working angle (i.e., an intake valve open period) has to be set to a greater value. Owing to a spring force of a valve spring permanently forcing the intake valve to remain closed, there is an increased tendency for a frictional loss of the valve operating system to increase.

The increased friction results in an insufficient rise in cranking speed during the early stage of cranking, and thus the engine startability deteriorates.

On hybrid vehicles each employing an automatic engine stop-restart system capable of temporarily automatically stopping an internal combustion engine during idling without depending on a driver's will, for example, under a specified condition where a selector lever of an automatic transmission is kept in its neutral position, the vehicle speed is zero, the engine speed is an idle speed, and the brake pedal is depressed, and automatically restarting the engine from the vehicle standstill state, the engine stop and restart operation is frequently executed. In such engine stop-restart system equipped hybrid vehicles, the vehicle drivability is greatly affected by a deterioration of engine startability.

It is, therefore, in view of the previously-described disadvantages of the prior art, an object of the invention to provide a variable valve actuation system of an internal combustion engine capable of effectively reducing noise and vibrations during an engine starting period, in particular, during an early stage of cranking, and additionally capable of enhancing the engine startability by reducing a friction of the valve operating system.

In order to accomplish the aforementioned and other objects of the present invention, a variable valve actuation system of an internal combustion engine comprises a variable valve actuator that variably adjusts at least an intake valve closure timing, and a control unit configured to be connected to at least the variable valve actuator for variably controlling the intake valve closure timing depending on engine operating conditions, the control unit comprising a processor programmed to control the intake valve closure timing to a timing value before a piston bottom dead center position on intake stroke during an engine starting period, wherein the variable valve actuator comprises a biasing device, which permanently biases the intake valve closure timing toward a piston top dead center position on the intake stroke.

According to another aspect of the invention, a variable valve actuation system of an internal combustion engine comprises a variable valve actuator that variably adjusts at least an intake valve closure timing, and a control unit configured to be connected to at least the variable valve actuator for variably controlling the intake valve closure timing depending on engine operating conditions, the control unit comprising stop control means for controlling the intake valve closure timing to a timing value after a piston top dead center position and before a piston bottom dead center position on intake stroke by the variable valve actuator during an engine stopping period, hold means for holding the intake valve closure timing at the timing value after the piston TDC position and before the piston BDC position on the intake stroke during a time period from a time when the engine is stopped to a time when the engine is restarted, and control means for phase-retarding the intake valve closure timing to a timing value close to the BDC position on the intake stroke by the variable valve actuator when the engine is cranked for engine restart and a cranking speed increases up to a predetermined speed value.

According to a further aspect of the invention, a variable valve actuation system of an internal combustion engine comprises a variable valve actuator that variably adjusts at least an intake valve closure timing, and a control unit configured to be connected to at least the variable valve actuator for variably controlling the intake valve closure timing depending on engine operating conditions, the control unit comprising a processor programmed to phase-advance the intake valve closure timing to a predetermined timing value after a piston top dead center position and before a piston bottom dead center position on intake stroke during at least one of an engine starting period and an engine stopping period, wherein the variable valve actuator comprises a biasing device, which permanently biases the intake valve closure timing toward the predetermined timing value.

According to another aspect of the invention, a method of controlling a variable valve actuation system of an internal combustion engine employing a variable valve actuator that variably adjusts at least an intake valve closure timing, the method comprises phase-advancing the intake valve closure timing to a predetermined timing value after a piston top dead center position and before a piston bottom dead center position on intake stroke by the variable valve actuator during an engine stopping period, phase-holding the intake valve closure timing at the predetermined timing value after the piston TDC position and before the piston BDC position on the intake stroke during a time period from a time when the engine is stopped to a time when the engine is restarted, and phase-retarding the intake valve closure timing to a timing value after and near the BDC position on the intake stroke by the variable valve actuator when the engine is cranked for engine restart and a cranking speed increases up to a predetermined speed value.

The other objects and features of this invention will become understood from the following description with reference to the accompanying drawings.

DESCRIPTION OF THE PREFERRED EMBODIMENTS

Figure 1:
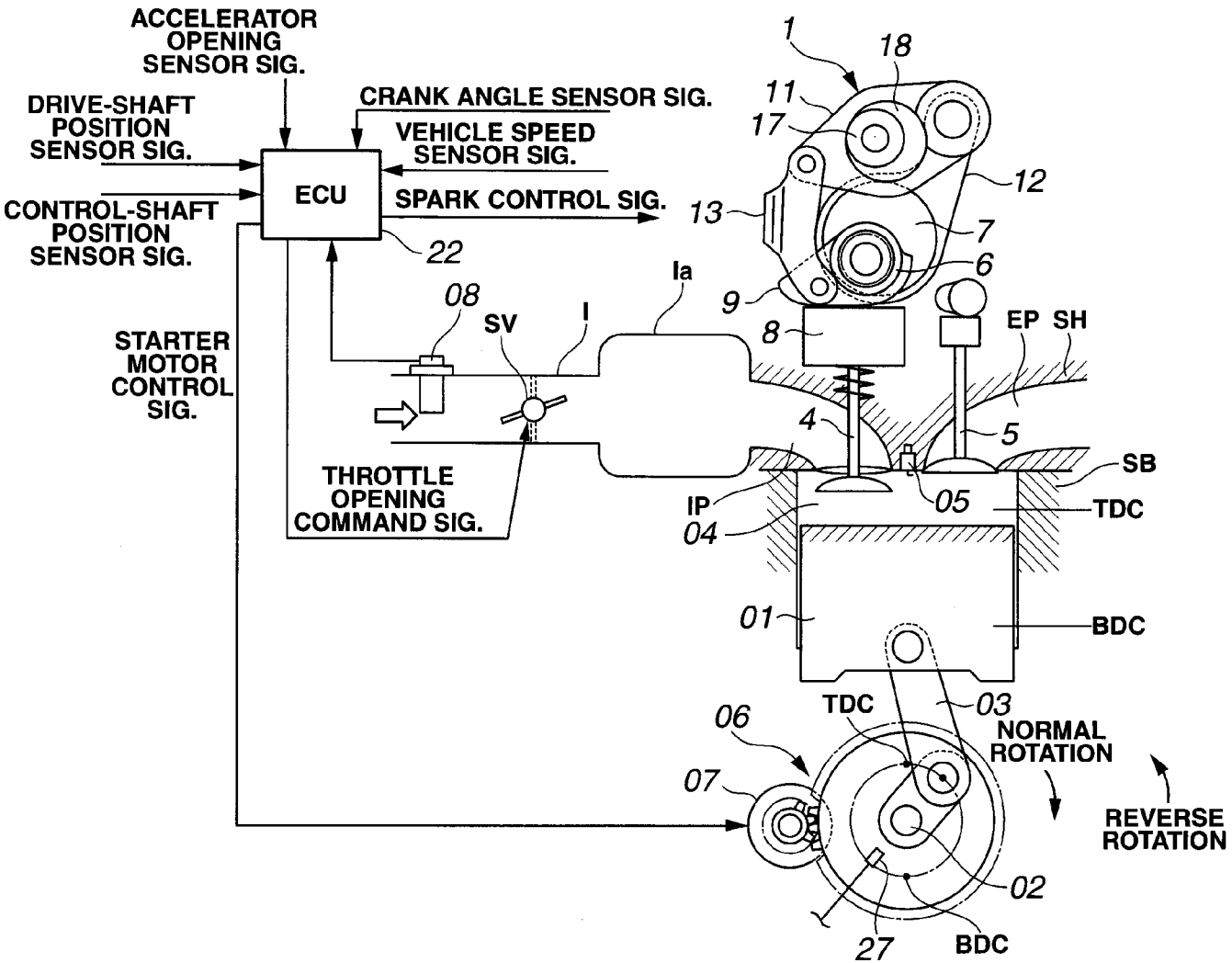
FIG. 1 is a schematic system diagram illustrating an internal combustion engine to which a variable valve actuation system of an embodiment can be applied.
Figure 2:
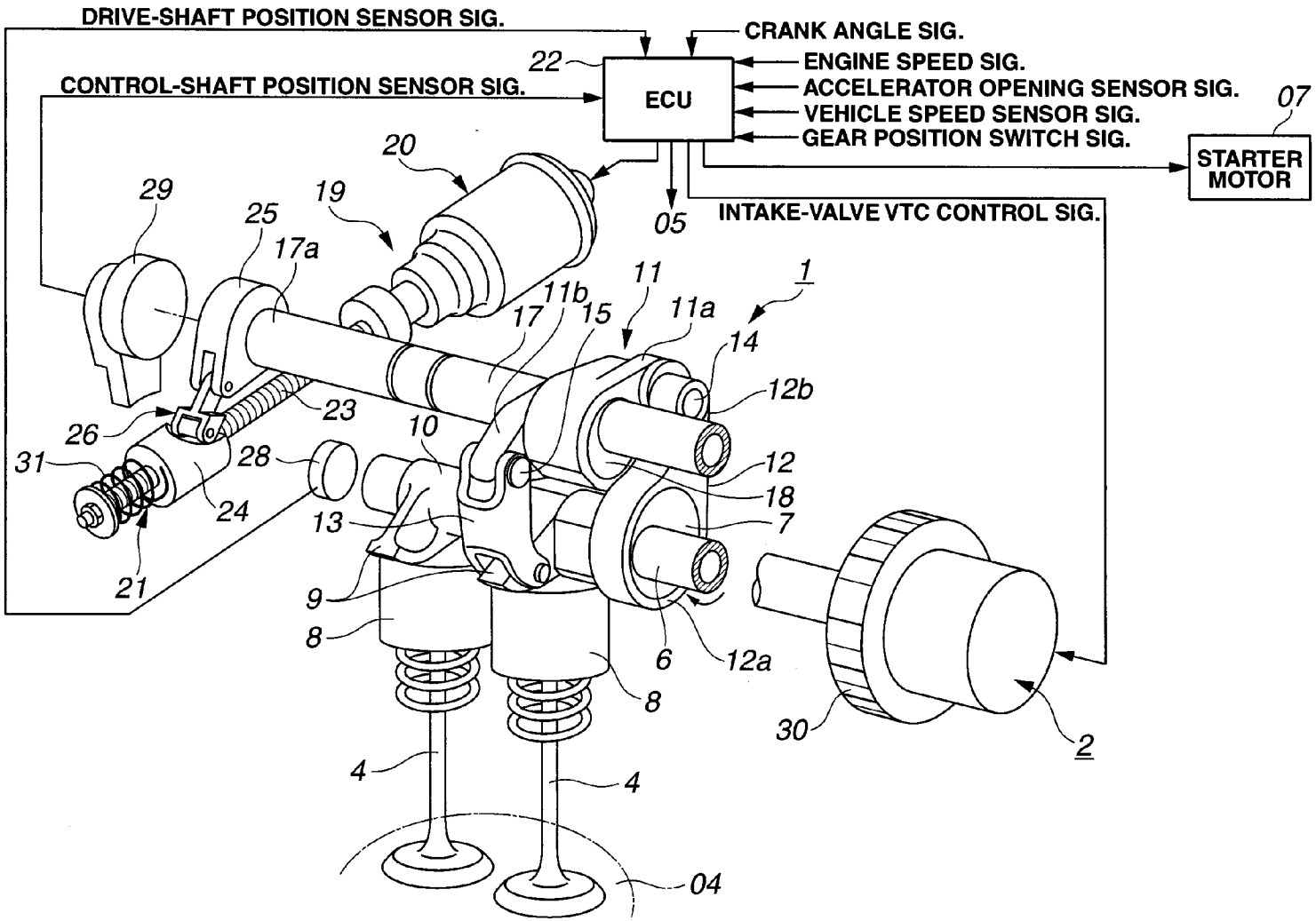
FIG. 2 is a perspective view illustrating the variable valve actuation system of the embodiment, which includes a continuously variable valve event and lift control (VEL) mechanism and a variable valve timing control (VTC) mechanism.

Referring now to the drawings, particularly to FIGS. 1-2, the variable valve actuation system of the embodiment is exemplified in a four-cycle multiple-cylinder internal combustion engine having four valves per cylinder, namely two intake valves 4, 4 (see FIGS. 1-2) and two exhaust valves 5, 5 (see FIG. 1).

The construction of the multiple-cylinder internal combustion engine, to which the variable valve actuation system of the embodiment can be applied, is hereunder described in detail in reference to the system diagram of FIG. 1. The engine of FIG. 1 is constructed by a cylinder block SB having a cylinder bore, a reciprocating piston 01 movable or slidable through a stroke in the cylinder bore, a cylinder head SH on the cylinder block SB, an intake port IP and an exhaust port EP formed in cylinder head SH, two intake valves 4, 4 each slidably installed on cylinder head SH for opening and closing the opening end of intake port IP, and two exhaust valves 5, 5 each slidably installed on cylinder head SH for opening and closing the opening end of exhaust port EP.

Piston 01 is connected to an engine crankshaft 02 via a connecting rod 03. A combustion chamber 04 is defined between the piston crown of piston 01 and the underside of cylinder head SH.

An electronically-controlled throttle valve unit SV is provided upstream of intake port IP and located in an interior space of an intake manifold Ia of an intake pipe I connected to intake port IP, for controlling a quantity of intake air. The intake-air quantity may be mainly controlled by means of a variable valve actuation device, simply, a variable valve actuator (described later in detail) of the variable valve actuation system, while electronically-controlled throttle valve unit SV may be provided to subsidiarily control a quantity of intake air for safety purposes and for creating a vacuum existing in the induction system for the purpose of recirculation of blow-by fumes in a blowby-gas recirculation system and/or canister purging in an evaporative emission control system, usually installed on practicable internal combustion engines. Electronically-controlled throttle valve unit SV is comprised of a round-disk throttle valve, a throttle position sensor, and a throttle actuator that is driven by means of an electric motor such as a step motor. The throttle position sensor is provided to detect the actual throttle opening amount of the throttle valve. The throttle actuator adjusts the throttle opening amount in response to a control command signal from a controller, exactly, an electronic engine control unit (ECU) 22 (described later). A fuel injector or a fuel injecting valve (not shown) is provided downstream of throttle valve unit SV. A spark plug 05 is located substantially in a middle of cylinder head SH.

As clearly shown in FIG. 1, engine crankshaft 02 can be rotated in a reverse-rotational direction and in a normal-rotational direction via a pinion gear mechanism 06 by means of a reversible starter motor (or a reversible cranking motor) 07.

As clearly shown in FIGS. 1-2, particularly, in FIG. 2, the variable valve actuator (variable valve operating means) of the variable valve actuation system of the embodiment is comprised of a variable valve event and lift control (VEL) mechanism 1 and a variable valve timing control (VTC) mechanism (or a variable phase control mechanism) 2. VEL mechanism 1 is able to simultaneously control or adjust or change both of a valve lift and a lifted-period (a working angle or a valve open period) of each of intake valves 4, 4. VTC mechanism 2 is able to advance or retard only a phase of each of intake valves 4, 4, while keeping a valve lift and working angle characteristic of each intake valve 4 constant. As the VEL mechanism 1, the variable valve actuation system of the embodiment uses a continuously variable valve event and lift control mechanism as disclosed in Japanese Patent Provisional Publication No. 2003-172112. Briefly speaking, as shown in FIG. 2, VEL mechanism 1 is comprised of a cylindrical hollow drive shaft 6, a ring-shaped drive cam 7, two rockable cams 9, 9, and a multinodular-link motion transmitting mechanism (or a motion converter) mechanically linked between drive cam 7 and the rockable-cam pair (9, 9) for transmitting a torque created by drive cam (eccentric cam) 7 as an oscillating force of each of rockable cams 9, 9. Cylindrical hollow drive shaft 6 is rotatably supported by bearings in the upper part of cylinder head SH. Drive cam 7 is formed as an eccentric cam that is press-fitted or integrally connected onto the outer periphery of drive shaft 6. Rockable cams 9, 9 are oscillatingly or rockably supported on the outer periphery of drive shaft 6 and in sliding-contact with respective upper contact surfaces of two valve lifters 8, 8, which are located at the valve stem ends of intake valves 4, 4. In other words, the motion transmitting mechanism (or the motion converter) is provided to convert a rotary motion (input torque) of drive cam 7 into an up-and-down motion (a valve opening force) of each intake valve 4 (i.e., an oscillating force creating an oscillating motion of each rockable cam 9).

Torque is transmitted from engine crankshaft 02 through a timing sprocket 30 fixedly connected to one axial end of drive shaft 6 via a timing chain (not shown) to drive shaft 6. As indicated by the arrow in FIG. 2, the direction of rotation of drive shaft 6 is set in a clockwise direction.

Drive cam 7 has an axial bore that is displaced from the geometric center of the cylindrical drive cam 7. Drive cam 7 is fixedly connected to the outer periphery of drive shaft 6, so that the inner peripheral surface of the axial bore of drive cam 7 is press-fitted onto the outer periphery of drive shaft 6. Thus, the center of drive cam 7 is offset from the shaft center of drive shaft 6 in the radial direction by a predetermined eccentricity (or a predetermined offset value).

As best seen from the axial rear views shown in FIGS. 2, 3A-3B and 4A-4B, each of rockable cams 9, 9 is formed as a substantially raindrop-shaped cam. Rockable cams 9, 9 have the same cam profile. Rockable cams 9, 9 are formed integral with respective axial ends of a cylindrical-hollow camshaft 10. Cylindrical-hollow camshaft 10 is rotatably supported on drive shaft 6. The outer peripheral contacting surface of rockable cam 9, in sliding-contact with the upper contact surface of valve lifter 8, includes a cam surface 9*a*. The base-circle portion of rockable cam 9 is integrally formed with or integrally connected to camshaft 10, to permit oscillating motion of rockable cam 9 on the axis of drive shaft 6. The outer peripheral surface (cam surface 9*a*) of rockable cam 9 is constructed by a base-circle surface, a circular-arc shaped ramp surface extending from the base-circle surface to a cam-nose portion, a top-circle surface (simply, a top surface) that provides a maximum valve lift (or a maximum lift amount), and a lift surface by which the ramp surface and the top surface are joined. The base-circle surface, the ramp surface, the lift surface, and the top surface abut predetermined positions of the upper surface of valve lifter 8, depending on the oscillatory position of rockable cam 9.

The motion transmitting mechanism (the motion converter) is comprised of a rocker arm 11 laid out above drive shaft 6, a link arm 12 mechanically linking one end (or a first armed portion 11*a*) of rocker arm 11 to the drive cam 7, and a link rod 13 mechanically linking the other end (a second armed portion 11*b*) of rocker arm 11 to the cam-nose portion of rockable cam 9.

Rocker arm 11 is formed with an axially-extending center bore (a through opening). The rocker-arm center bore of rocker arm 11 is rotatably fitted onto the outer periphery of a control cam 18 (described later), to cause a pivotal motion (or an oscillating motion) of rocker arm 11 on the axis of control cam 18. The first armed portion 11*a* of rocker arm 11 extends from the axial center bore portion in a first radial direction, whereas the second armed portion 11*b* of rocker arm 11 extends from the axial center bore portion in a second radial direction substantially opposite to the first radial direction. The first armed portion 11*a* of rocker arm 11 is rotatably pin-connected to link arm 12 by means of a connecting pin 14, while the second armed portion 11*b* of rocker arm 11 is rotatably pin-connected to one end (a first end 13*a*) of link rod 13 by means of a connecting pin 15.

Link arm 12 is comprised of a comparatively large-diameter annular base portion 12*a* and a comparatively small-diameter protruding end portion 12*b* radially outwardly extending from a predetermined portion of the outer periphery of large-diameter annular base portion 12*a*. Large-diameter annular base portion 12*a* is formed with a drive-cam retaining bore, which is rotatably fitted onto the outer periphery of drive cam 7. On the other hand, small-diameter protruding end portion 12*b* of link arm 12 is pin-connected to the first armed portion 11*a* of rocker arm 11 by means of connecting pin 14.

Link rod 13 is pin-connected at the other end (a second end 13*b*) to the cam-nose portion of rockable cam 9 by means of a connecting pin 16.

Also provided is a motion-converter attitude control mechanism that changes an initial actuated position (a fulcrum of oscillating motion of rocker arm 11) of the motion transmitting mechanism (or the motion converter). As clearly shown in FIGS. 3A-3B and 4A-4B, the attitude control mechanism includes a control shaft 17 and control cam 18. Control shaft 17 is located above and arranged in parallel with drive shaft 6 in such a manner as to extend in the longitudinal direction of the engine, and rotatably supported on cylinder head SH by means of the same bearing members as drive shaft 6. Control cam 18 is attached to the outer periphery of control shaft 17 and slidably fitted into and oscillatingly supported in a control-cam retaining bore formed in rocker arm 11. Control cam 18 serves as a fulcrum of oscillating motion of rocker arm 11. Control cam 18 is integrally formed with control shaft 17, so that control cam 18 is fixed onto the outer periphery of control shaft 17. Control cam 18 is formed as an eccentric cam having a cylindrical cam profile. The axis (the geometric center) of control cam 18 is displaced a predetermined distance from the axis of control shaft 17.

As shown in FIG. 2, the attitude control mechanism also includes a drive mechanism 19. Drive mechanism 19 is comprised of a geared motor or an electric control-shaft actuator 20 fixed to one end of a housing (not shown) and a ball-screw motion-transmitting mechanism (simply, a ball-screw mechanism) 21 that transmits a motor torque created by motor 20 to control shaft 17. In more detail, motor 20 is constructed by a proportional control type direct-current (DC) motor. Motor 20 is controlled in response to a control signal, which is generated from the output interface circuitry of ECU 22 and whose signal value is determined based on engine/vehicle operating conditions.

Ball-screw mechanism 21 is comprised of a ball-screw shaft (or a worm shaft) 23 coaxially aligned with and connected to the motor output shaft of motor 20, a substantially cylindrical, movable ball nut 24 threadably engaged with the outer periphery of ball-screw shaft 23, a link arm 25 fixedly connected to the rear end 17*a* of control shaft 17, a link member 26 mechanically linking link arm 25 to ball nut 24, and recirculating balls interposed between the worm teeth of ball-screw shaft 23 and guide grooves cut in the inner peripheral wall surface of ball nut 24. In a conventional manner, a rotary motion (input torque) of ball-screw shaft 23 is converted into a rectilinear motion of ball nut 24 through the recirculating balls. Ball nut 24 is axially forced toward motor 20 by the spring force of a return spring (a coil spring) 31, serving as a biasing device or biasing means, in a manner so as to eliminate a backlash between ball-screw shaft 23 and ball nut 24 threadably engaged with each other. The direction of the spring force (spring bias) of return spring 31 corresponds to a direction that the VEL mechanism is biased to a minimum valve lift and working angle characteristic (in other words, in a maximum phase-advance direction of intake valve closure timing).

Hereunder described briefly in reference to FIGS. 2, 3A-3B, 4A-4B, and 5 is the operation of VEL mechanism 1. During a stopping period of the engine, motor 20 of VEL mechanism 1 is driven in response to a control signal generated from the output interface circuitry of ECU 22 just before the engine is brought into a stopped state. Thus, ball-screw shaft 23 is rotated by input torque created by motor 20, thereby producing a maximum rectilinear motion of ball nut 24 in one ball-nut axial direction that ball nut 24 approaches close to motor 20. As a result, control shaft 17 rotates in one rotational direction via a linkage comprised of link member 26 and link arm 25.

Figure 3A:
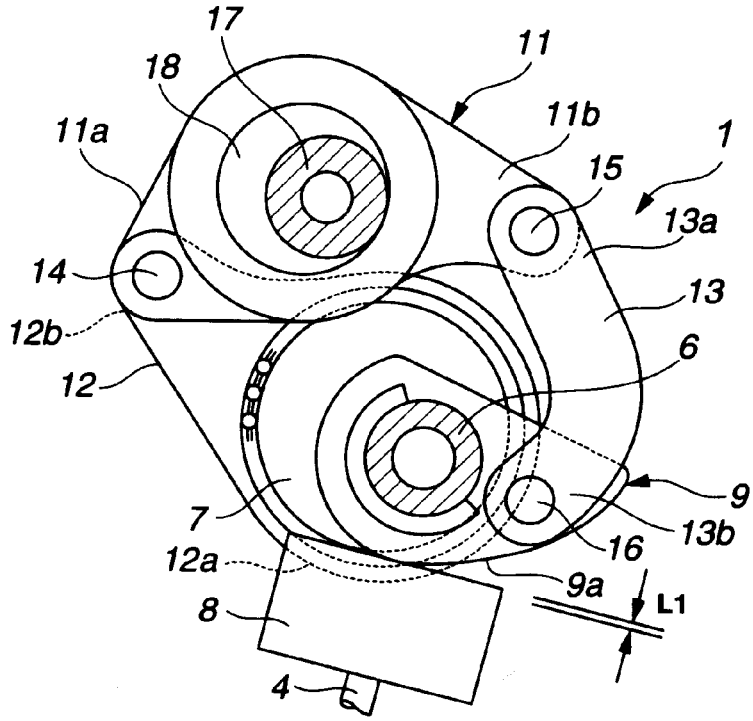
FIGS. 3A-3B are axial rear views showing the operation of the intake-valve VEL mechanism during a small-lift control mode.
Figure 3B:
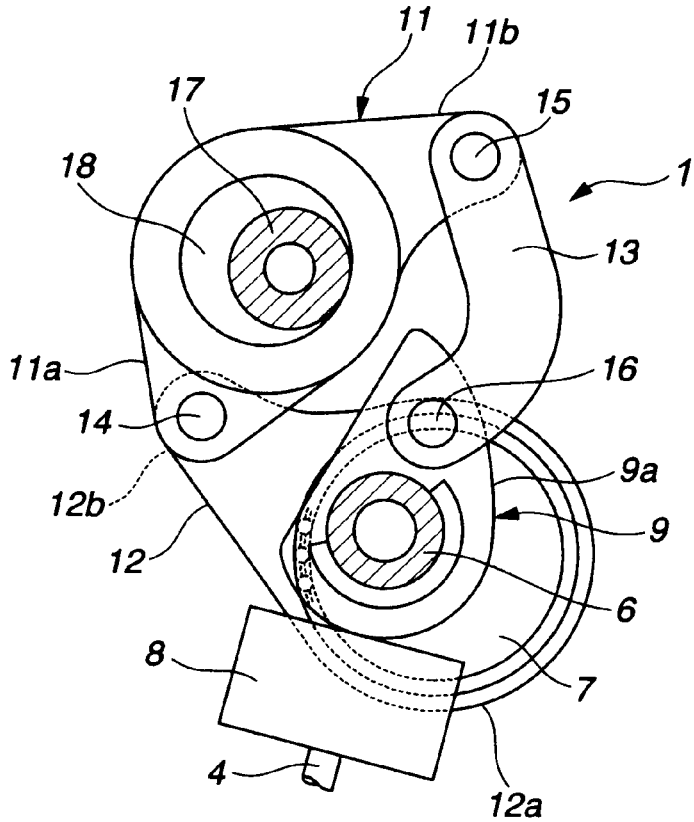

As can be seen from the angular position of control cam 18 shown in FIGS. 3A-3B, by way of revolving motion of the center of control cam 18 around the center of control shaft 17, the radially thick-walled portion of control cam 18 shifts upwards apart from drive shaft 6 and is held at the upwardly shifted position, with the result that the pivot (the connected point by connecting pin 15) between the second armed portion 11*b* of rocker arm 11 and the first rod end 13*a* of link rod 13 also shifts upwards with respect to drive shaft 6. As a result, the cam-nose portion of each of rockable cams 9, 9 is forcibly pulled up via the second rod end 13*b* of link rod 13. As viewed from the rear end of drive shaft 6, the angular position of each rockable cam 9 shown in FIGS. 3A-3B is relatively shifted to the counterclockwise direction from the angular position of each rockable cam 9 shown in FIGS. 4A-4B.

With control cam 18 held at the angular position shown in FIGS. 3A-3B, when drive cam 7 is rotated, a rotary motion of drive cam 7 is converted through link arm 12, the first armed portion 11*a* of rocker arm 11, the second armed portion 11*b* of rocker arm 11, and link rod 13 into an oscillating motion of rockable cam 9, but almost the base-circle surface area of rockable cam 9 is brought into sliding-contact with the upper contact surface of valve lifter 8 (see FIGS. 3A-3B). Thus, the actual intake-valve lift becomes a small lift L1 and simultaneously the actual intake-valve working angle becomes a small working angle D1 (see the small intake-valve lift L1 and small working angle D1 characteristic shown in FIG. 5).

Thus, just before the engine has been completely stopped, intake valve closure timing IVC of each of intake valves 4, 4 can be controlled to a phase-advanced valve closure timing value P1. Additionally, by way of the spring force of return spring 31, the VEL mechanism can be certainly forced toward the minimum lift L1 and minimum working angle D1 characteristic. That is, by virtue of the spring bias of return spring 31, VEL mechanism 1 tends to be stably held in a small lift and working angle characteristic. Regardless of the presence or absence of frictional resistances, it is possible to more stably certainly shift VEL mechanism 1 to the small lift and working angle characteristic by the spring force of return spring 31. The above-mentioned frictional resistances often arise from (i) a friction against sliding motion of drive cam 7 (eccentric cam fixed to drive shaft 6) within the drive-cam retaining bore of link arm 12, and (ii) a friction against sliding motion of control cam 18 (eccentric cam fixed to control shaft 17) within the rocker-arm center bore of rocker arm 11.

When starting the engine, first, the ignition switch is turned ON and thus starter motor 07 is driven to initiate cranking operation for crankshaft 02. At such an early stage of cranking, the valve lift is maintained at a small lift characteristic by virtue of the spring force of return spring 31. At the same time, the working angle becomes small working angle D1. Thus, intake valve closure timing, often abbreviated to "IVC", of each of intake valves 4, 4 is phase-advanced from the piston BDC position. Therefore, by way of synergistic effect of the decompression effect and the low friction effect achieved by small lift and working angle characteristic, it is possible to speedily increase cranking speed. On the other hand, intake valve open timing, often abbreviated to "IVO" is set to a timing value near a piston top dead center (TDC) position during an engine starting period (during engine start-up). The intake valve open timing value near TDC is advantageous to eliminate valve overlap. As a result of the previously-noted proper settings of IVO and IVC, it is possible to set the intake valve characteristic to a small lift and working angle characteristic.

Immediately when cranking speed increases up to a predetermined speed value, motor 20 is rotated in a reverse-rotational direction responsively to a control signal, which is generated from the output interface circuitry of ECU 22. Thus, ball-screw shaft 23 is also rotated in the reverse-rotational direction by reverse-rotation of the motor output shaft of motor 20, thereby producing the opposite rectilinear motion of ball nut 24. As a result, control shaft 17 rotates in the opposite rotation direction via the linkage (25, 26).

By way of revolving motion of the center of control cam 18 around the center of control shaft 17, the radially thick-walled portion of control cam 18 slightly downwardly shifts toward drive shaft 6 and is held at the slightly downwardly shifted position. Thus, the attitude of rocker arm 11 slightly shifts clockwise from the angular position of rocker arm 11 shown in FIGS. 3A-3B, with the result that the pivot (the connected point by connecting pin 15) between the second armed portion 11*b* of rocker arm 11 and the first rod end 13*a* of link rod 13 also shifts slightly downwards. As a result, the cam-nose portion of each of rockable cams 9, 9 is forcibly slightly pushed down via the second rod end 13*b* of link rod 13. As viewed from the rear end of drive shaft 6, the angular position of each rockable cam 9 is relatively shifted to the clockwise direction from the angular position of each rockable cam 9 shown in FIGS. 3A-3B.

Figure 4A:
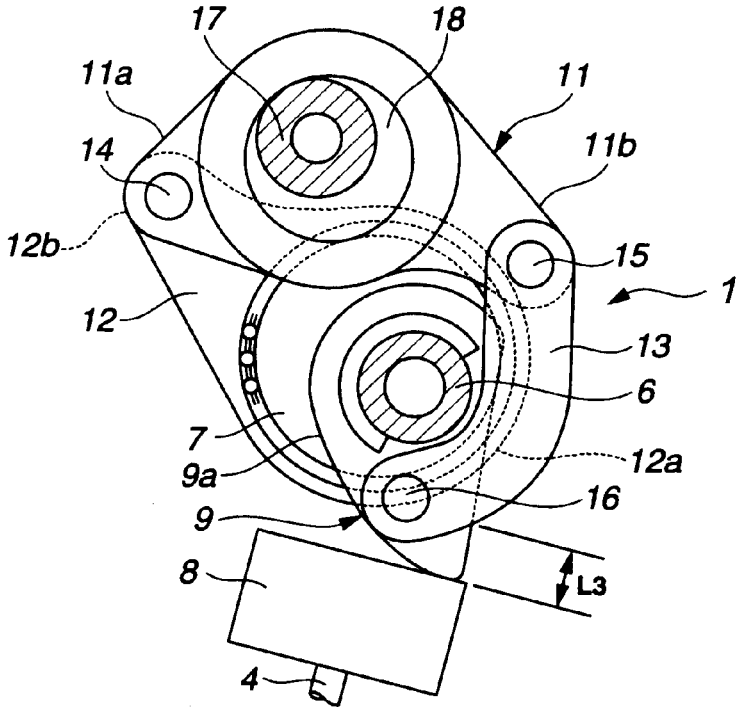
FIGS. 4A-4B are axial rear views showing the operation of the intake-valve VEL mechanism during a large-lift control mode.
Figure 4B:
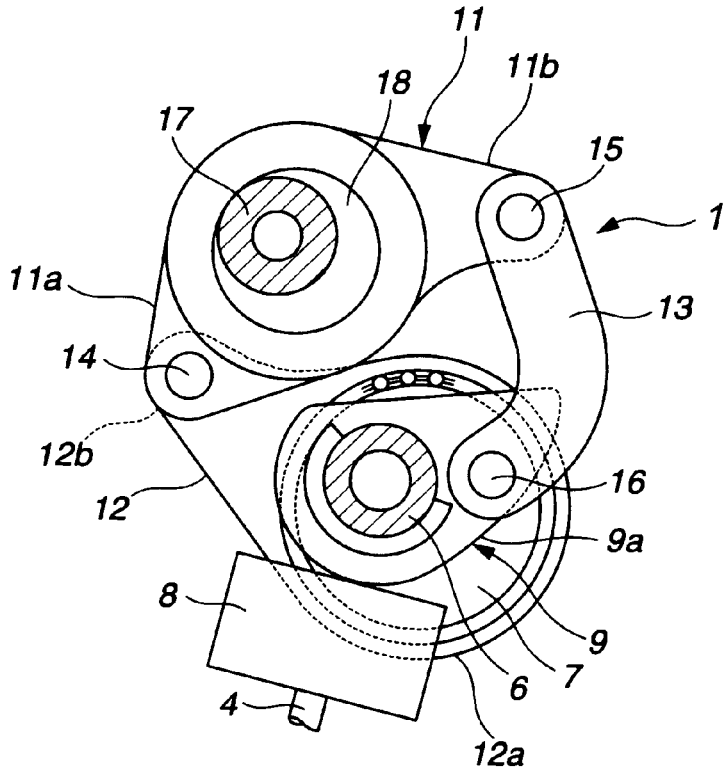

With control cam 18 shifted from the angular position shown in FIGS. 3A-3B to the intermediate angular position located in a substantially middle of the angular position shown in FIGS. 3A-3B and the angular position shown in FIGS. 4A-4B, during rotation of drive cam 7, a rotary motion of drive cam 7 is converted through link arm 12, the first armed portion 11*a* of rocker arm 11, the second armed portion 11*b* of rocker arm 11, and link rod 13 into an oscillating motion of rockable cam 9. At this time, a part of the base-circle surface area, the ramp surface area, the lift surface area, and the top surface area are brought into sliding-contact with the upper contact surface of valve lifter 8. Thus, when varying from the angular position of control cam 18 shown in FIGS. 3A-3B to the intermediate angular position, the actual intake-valve lift and working angle characteristic can be quickly varied from the small intake-valve lift L1 and small working angle D1 characteristic to a middle intake-valve lift L2 and middle working angle D2 characteristic (see FIG. 5). That is, intake-valve working angle as well as intake-valve lift can be simultaneously increased. Owing to a valve lift increase (L1→L2) and a working angle increase (D1→D2), intake valve closure timing IVC is phase-retarded and controlled to a timing value near BDC. Thus, an effective compression ratio becomes high to ensure good combustion. Additionally, a charging efficiency of fresh air tends to become high, thus resulting in an increase in torque generated by combustion and a smooth rise in engine speed, and consequently ensuring and realizing complete explosion with satisfactory combustion of the compressed air-fuel mixture.

In a low-speed low-load range after engine warm-up, the actual intake-valve lift and working angle characteristic is controlled or reduced to the small intake-valve lift L1 and small working angle D1 characteristic by means of VEL mechanism 1. At the same time, intake valve closure timing IVC is phase-retarded by means of VTC mechanism 2. As a result, a valve overlap period, during which intake and exhaust valves 4 and 5 are at least partly open, becomes small, thus improving the combustion stability. Additionally, owing to the small lift, a frictional loss of the valve operating system becomes small, thereby ensuring the improved fuel economy.

Thereafter, when the engine/vehicle operating condition is shifting from the low-speed low-load range to a middle-speed middle-load range, the actual intake-valve lift and working angle characteristic is controlled or enlarged to the middle intake-valve lift L2 and middle working angle D2 characteristic by means of VEL mechanism 1 electronically controlled by ECU 22. At the same time, intake valve closure timing IVC is phase-advanced by means of VTC mechanism 2. As a result of valve lift and working angle control of VEL mechanism 1 combined with phase-advance control of VTC mechanism 2, the valve overlapping period becomes large, thus reducing a pumping loss and ensuring reduced fuel consumption.

After this, when the engine/vehicle operating condition is shifting from the low or middle load range to a high load range, motor 20 is further driven in the reverse-rotational direction responsively to a control signal, which is generated from the output interface circuitry of ECU 22 and determined based on the high engine load condition. Thus, ball-screw shaft 23 is further rotated in the reverse-rotational direction by reverse-rotation of the motor output shaft of motor 20, thereby producing the further opposite rectilinear motion of ball nut 24. As a result, control shaft 17 further rotates in the opposite rotation direction via the linkage (25, 26). By way of further revolving motion of the center of control cam 18 around the center of control shaft 17, the radially thick-walled portion of control cam 18 further shifts downwards and is held at the downwardly shifted position. Thus, the attitude of rocker arm 11 further shifts clockwise, with the result that the pivot (the connected point by connecting pin 15) between the second armed portion 11*b* of rocker arm 11 and the first rod end 13*a* of link rod 13 further shifts downwards. As a result, the cam-nose portion of each of rockable cams 9, 9 is further forcibly pushed down via the second rod end 13*b* of link rod 13. As viewed from the rear end of drive shaft 6, the angular position of each rockable cam 9 is further shifted clockwise. With control cam 18 shifted to the angular position (suited to high load operation) shown in FIGS. 4A-4B, during rotation of drive cam 7, a rotary motion of drive cam 7 is converted through the motion transmitting mechanism (links 11, 12, and 13) into an oscillating motion of rockable cam 9. At this time, a part of the base-circle surface area, the ramp surface area, the lift surface area, and the top surface area are brought into sliding-contact with the upper contact surface of valve lifter 8. Thus, when switching from the intermediate angular position (suited to middle load operation) of control cam 18 to the angular position (suited to high load operation) shown in FIGS. 4A-4B, the actual intake-valve lift and working angle characteristic can be continuously varied from the middle intake-valve lift L2 and middle working angle D2 characteristic to a large intake-valve lift L3 and large working angle D3 characteristic (see FIG. 5).

Figure 5:
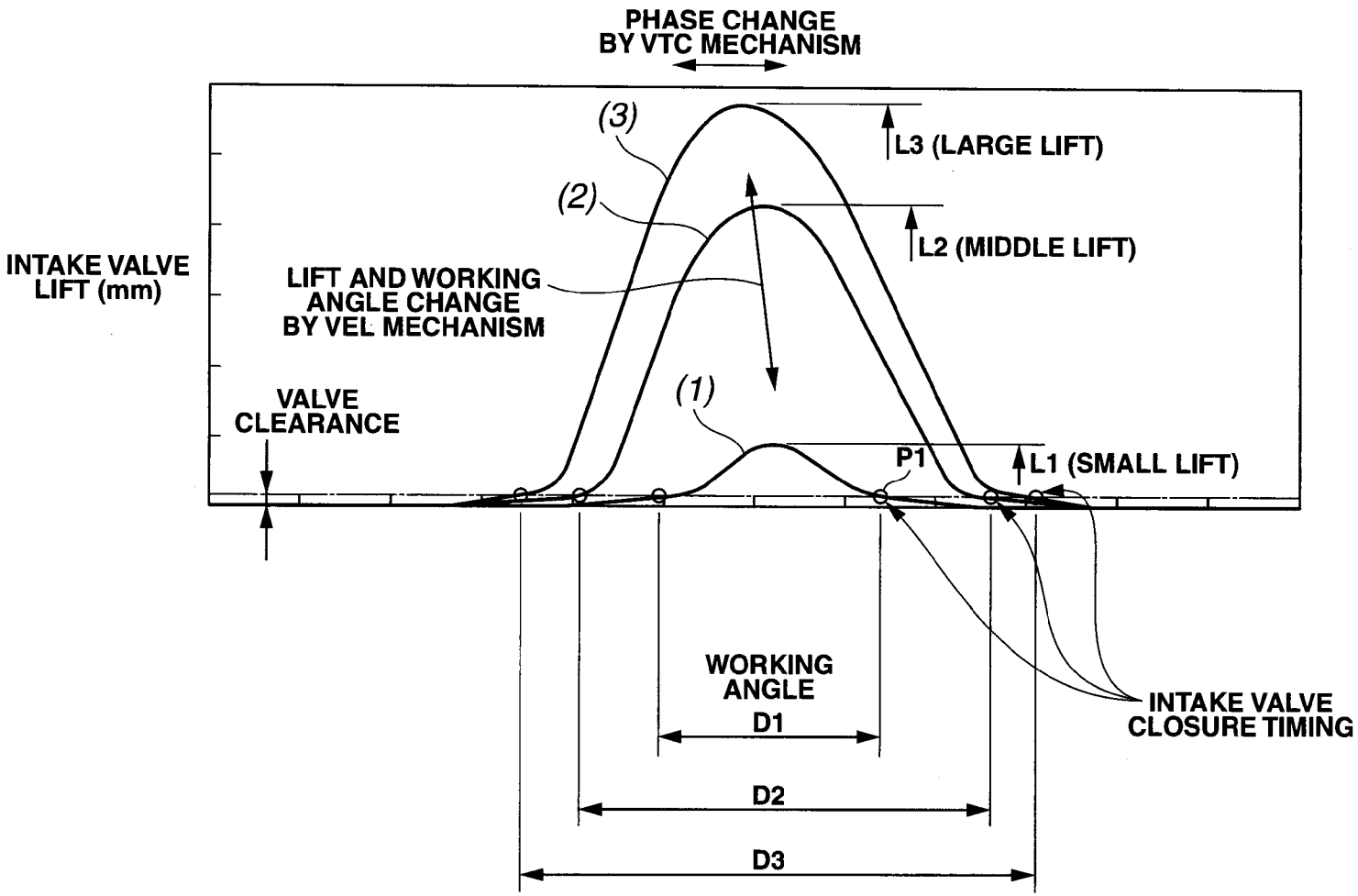
FIG. 5 is a variable intake-valve lift and event (working angle) and phase characteristic diagram, obtained by both of the intake-valve VEL and VTC mechanisms of the variable valve actuation system of the embodiment.

As can be appreciated from a plurality of intake-valve lift L and intake-valve working angle D characteristic curves (or a plurality of intake-valve lift L and lifted-period D characteristic curves) shown in FIG. 5, according to VEL mechanism 1 incorporated in the variable valve actuation system of the embodiment, through all engine operating conditions from low engine load to high engine load, the intake-valve lift and working angle characteristic can be continuously controlled or adjusted from the small intake-valve lift L1 and working angle D1 characteristic via the middle intake-valve lift L2 and working angle D2 characteristic to the large intake-valve lift L3 and working angle D3 characteristic, or vice versa. That is to say, the intake-valve lift and working angle characteristic can be controlled or adjusted to an optimal characteristic suited to the latest up-to-date information concerning engine operating condition.

Figure 6:
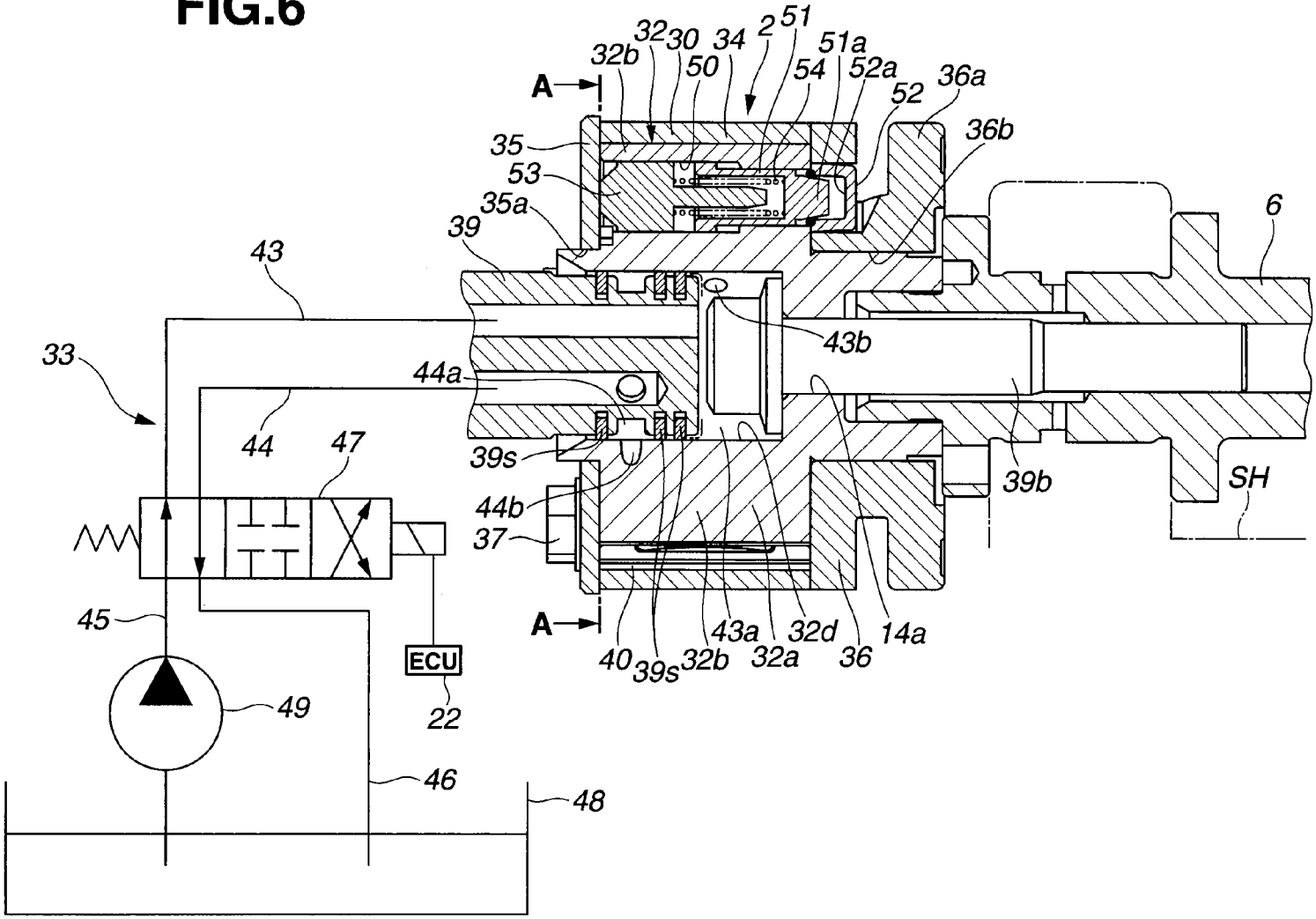
FIG. 6 is a cross-sectional view showing the VTC mechanism included in the variable valve actuation system of the embodiment.
Figure 7:
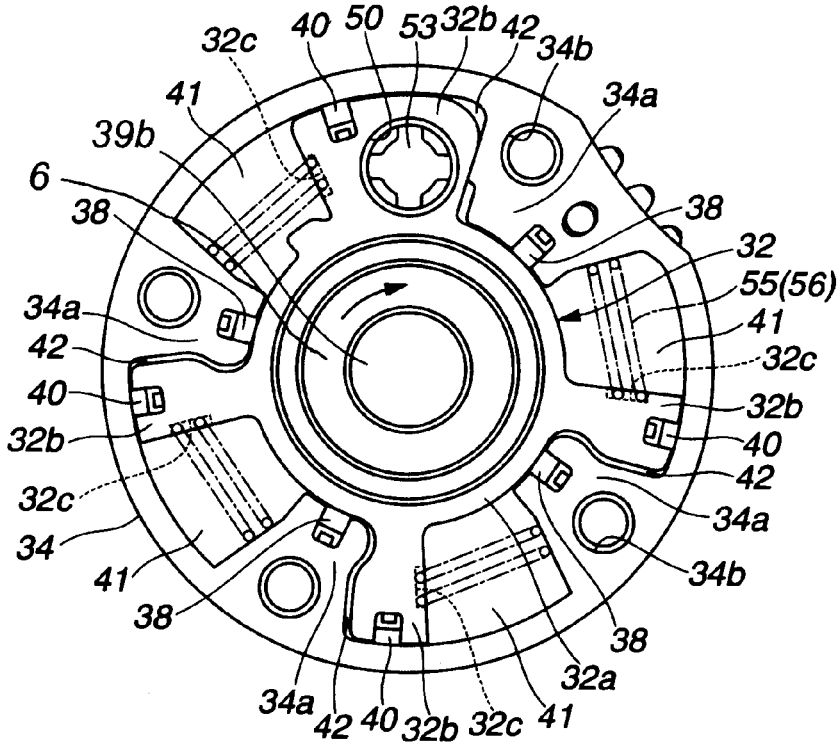
FIG. 7 is a lateral cross-section taken along the line A-A of FIG. 6, and showing the maximum phase-advance state of the VTC mechanism.

In the shown embodiment, the previously-described VTC mechanism 2 comprises a so-called hydraulically-operated rotary vane type VTC mechanism. As shown in FIGS. 6 and 7, VTC mechanism 2 is comprised of timing sprocket 30 fixedly connected to drive shaft 6 for torque transmission, a four-blade vane member 32 fixedly connected or bolted to the shaft end of drive shaft 6 and rotatably accommodated in the internal space of timing sprocket 30, and a hydraulic circuit 33, which hydraulically operates vane member 32 in a manner so as to rotate vane member 32 in selected one of normal-rotational and reverse-rotational directions.

Timing sprocket 30 is comprised of a substantially cylindrical, phase-converter housing 34 rotatably accommodating therein vane member 32, a disk-shaped front cover 35 hermetically covering the front opening end of housing 34, and a disk-shaped rear cover 36 hermetically covering the rear opening end of housing 34. Housing 34 and front and rear covers 35-36 are axially connected integral with each other by tightening four bolts 37.

Housing 34 is substantially cylindrical in shape and opened at both axial ends. Housing 34 has four shoes 34*a*, 34*a*, 34*a*, 34*a* evenly spaced around its entire circumference and serving as four partition walls radially inwardly extending from the inner periphery of the housing.

Each of shoes 34*a* is trapezoidal in cross section, and has an axially-extending bolt insertion hole 34*b* formed in its substantially central portion such that bolt 37 is inserted into the bolt insertion hole. As best seen in FIG. 7, each of shoes 34*a* has an axially-elongated seal groove formed in its apex. Four elongated oil seals 38, 38, 38, 38 each having a substantially C-shape in lateral cross section, are fitted into and retained in the respective seal grooves of shoes 34*a*. Although it is not clearly shown in FIG. 7, actually, four leaf springs are fitted into and retained in the respective seal grooves of shoes 34*a* in such a manner as to radially inwardly force the respective oil seals 38 against the outer peripheral wall surface of a vane rotor 32*a* (described later).

The previously-noted disk-shaped front cover 35 has a comparatively large-diameter center supporting bore 35*a* and circumferentially equidistant-spaced bolt holes (not numbered) bored to axially conform to the respective bolt insertion holes 34*b* of shoes 34*a* of housing 34.

The previously-noted disk-shaped rear cover 36 is integrally formed at its rear end with a toothed portion 36*a*, which is in meshed-engagement with the timing chain. Also, rear cover 36 has a substantially center bearing bore 36*b* having a comparatively large diameter.

Vane member 32 is comprised of a substantially annular ring-shaped vane rotor 32*a* formed with a center bolt insertion hole and radially-extending four vanes or blades 32*b*, 32*b*, 32*b*, 32*b* evenly spaced around the entire circumference of vane rotor 32*a* and integrally formed on the outer periphery of vane rotor 32*a*.

A small-diameter, cylindrical-hollow front end portion of vane rotor 32*a* is rotatably supported in the center bore 35*a* of front cover 35. A small-diameter, cylindrical-hollow rear end portion of vane rotor 32*a* is also rotatably supported in the bearing bore 36*b* of rear cover 36.

Vane rotor 32*a* of vane member 32 has an axially-extending central bore 14*a* into which a vane mounting bolt 39*b* is inserted for bolting vane member 32 to the front axial end of drive shaft 6 by axially tightening vane mounting bolt 39*b*.

One of four vane blades 32*b*, 32*b*, 32*b*, 32*b* is configured to have an inverted trapezoidal shape in lateral cross section, whereas the remaining three vane blades are configured to be substantially rectangular in lateral cross section. The remaining three blades have almost the same circumferential width and the same radial length. The circumferential width of the one blade having the inverted trapezoidal shape is dimensioned to be greater than that of each of the remaining three rectangular blades, taking account of total weight balance of vane member 32, in other words, reduced rotational unbalance of vane member 32 having four blades 32*b*.

Each of four blades 32*b*, 32*b*, 32*b*, 32*b* is disposed in an internal space defined between the associated two adjacent shoes 34*a* and 34*a*. As best seen in FIG. 7, four apex seals 40, 40, 40, and 40, each being substantially C-shaped in lateral cross section, are fitted into and retained in respective seal grooves formed in apexes of four blades 32*b*, so that each of blades 32*b* is slidable along the inner peripheral wall surface of phase-converter housing 34. Although it is not clearly shown in FIG. 7, actually, four leaf springs are fitted into and retained in the respective seal grooves of the apexes of blades 32*b* in such a manner as to radially inwardly force the respective apex seals 40 against the inner peripheral wall surface of housing 34. The backward sidewall surface of each blade 32*b*, opposing to the rotational direction of drive shaft 6, is formed with substantially circular, two concave grooves 32*c* and 32*c*, which serve as spring retaining holes for two rows of return springs 55-56. Return springs 55-56 are disposed between the spring-retaining-hole equipped backward sidewall surface of blade 32*b* and a spring-retaining sidewall surface of shoe 34*a* opposing to the backward sidewall surface of blade 32*b*.

Four blades 32*b* of vane member 32 and four shoes 34*a* of housing 34 cooperate with each other to define four variable-volume phase-advance chambers 41 and four variable-volume phase-retard chambers 42. In more detail, each of phase-advance chambers 41 is defined between the spring-retaining-hole equipped backward sidewall surface of blade 32*b* and the opposing spring-retaining sidewall surface of shoe 34*a*. Each of phase-retard chambers 42 is defined between the non-spring-retaining-hole equipped forward sidewall surface of blade 32*b* and the opposing non-spring-retaining sidewall surface of shoe 34*a*.

As clearly shown in FIG. 6, hydraulic circuit 33 is comprised of a first hydraulic line 43 provided to supply and exhaust working fluid (hydraulic pressure) to and from each of phase-advance chambers 41, and a second hydraulic line 44 provided to supply and exhaust working fluid (hydraulic pressure) to and from each of phase-retard chambers 42. That is, hydraulic circuit 33 comprises a dual hydraulic line system (43, 44). Each of hydraulic lines 43 and 44 are connected through an electromagnetic solenoid-operated directional control valve 47 to a working-fluid supply passage 45 and a working-fluid drain passage 46. A one-way oil pump 49 is disposed in supply passage 45 for sucking working fluid in an oil pan 48 and for discharging the pressurized working fluid from its discharge port. The downstream end of drain passage 46 communicates oil pan 48.

$1^{st}$ and $2^{nd}$ hydraulic lines 43 and 44 are formed in a substantially cylindrical flow-passage structure 39. One end (i.e., a first end) of flow-passage structure 39 is inserted through the left-hand axial opening end of the small-diameter, cylindrical-hollow front end portion of vane rotor 32*a* into a cylindrical bore 32*d* formed in vane rotor 32*a*. The other end (i.e., a second end) of flow-passage structure 39 is connected to electromagnetic solenoid-operated directional control valve 47. Three annular seals 39*s*, 39*s*, 39*s* are disposed between the outer periphery of the first end of flow-passage structure 39 and the inner periphery of cylindrical bore 32*d* of vane rotor 32*a*. In more detail, annular seals 39*s* are fitted into and retained in respective seal grooves formed in the outer periphery of the first end of flow-passage structure 39. These annular seals 39*s* act to partition between a phase-advance-chamber communication port of $1^{st}$ hydraulic line 43 and a phase-retard-chamber communication port of $2^{nd}$ hydraulic line 44 in a fluid-tight fashion.

$1^{st}$ hydraulic line 43 is further provided with a working-fluid chamber 43*a* and four branch passages 43*b*, 43*b*, 43*b*, 43*b*. $1^{st}$ hydraulic line 43 penetrates through the first end face of flow-passage structure 39, and the axial passage of $1^{st}$ hydraulic line 43 communicates working-fluid chamber 43*a*. Working-fluid chamber 43*a* is formed as the inner half of cylindrical bore 32*d* of vane rotor 32*a*, facing drive shaft 6. Four branch passages 43*b* are formed in vane rotor 32*a* in such a manner as to substantially radially extend from the inner periphery of cylindrical bore 32*d*. Four phase-advance chambers 41 are communicated with working-fluid chamber 43*a* via respective branch passages 43*b*.

On the other hand, the axial passage of $2^{nd}$ hydraulic line 44 extends near the first end face of flow-passage structure 39. $2^{nd}$ hydraulic line 44 is further provided with an annular chamber 44*a* and a second working-fluid passage 44*b*. Annular chamber 44*a* is formed in the outer periphery of the cylindrical portion of the first end of flow-passages structure 39. Although it is not clearly shown in the drawing, $2^{nd}$ working-fluid passage 44*b* has a substantially L shape and formed in vane rotor 32*a*. Annular chamber 44*a* and each of phase-retard chambers 42 are communicated with each other via $2^{nd}$ working-fluid passage 44*b*.

In the shown embodiment, electromagnetic solenoid-operated directional control valve 47 is constructed by a four-port, three-position, spring-offset solenoid-actuated directional control valve. Directional control valve 47 uses a sliding valve spool to change the path of flow through the directional control valve. For a given position of the valve spool, a unique flow path configuration exists within the valve. Concretely, directional control valve 47 is designed to switch among three positions of the spool, namely a spring-offset position shown in FIG. 6, a block-off position (a center position created due to the balancing opposing forces, that is, the return spring force and the electromagnetic force produced by the solenoid), and a fully solenoid-actuated position. In the spring-offset position, fluid communication between $1^{st}$ hydraulic line 43 and supply passage 45 is established, and fluid communication between $2^{nd}$ hydraulic line 44 and drain passage 46 is established. In the block-off position, fluid communication between each of $1^{st}$ and $2^{nd}$ hydraulic lines 43-44 and each of supply passage 45 and drain passage 46 is blocked. In the fully solenoid-actuated position, fluid communication between $1^{st}$ hydraulic line 43 and drain passage 46 is established, and fluid communication between $2^{nd}$ hydraulic line 44 and supply passage 45 is established. Switching operation among the three positions of the valve spool of directional control valve 47 is executed responsively to a control command signal generated from the output interface circuitry of ECU 22 to the solenoid.

The controller (ECU) 22 is common to both of VEL mechanism 1 and VTC mechanism 2. Returning to FIG. 1, ECU 22 generally comprises a microcomputer. ECU 22 includes an input/output interface circuitry (I/O), memories (RAM, ROM), and a microprocessor or a central processing unit (CPU). The input/output interface circuitry (I/O) of ECU 22 receives input information from various engine/vehicle switches and sensors, namely a crank angle sensor 27, an engine speed sensor, an accelerator opening sensor, a vehicle speed sensor, a range gear position switch, a drive-shaft angular position sensor 28, a control-shaft angular position sensor 29, and an airflow meter 08. Within ECU 22, the central processing unit (CPU) allows the access by the I/O interface of input informational data signals from the previously-discussed engine/vehicle switches and sensors. The processor of ECU 22 determines the current engine/vehicle operating condition, based on input information from the engine/vehicle switches and sensors. Crank angle sensor 27 is provided to detect an angular position (crankangle) of crankshaft 02. Drive-shaft angular position sensor 28 is provided for detecting an angular position of drive shaft 6. Also, based on both of the sensor signals from crank angle sensor 27 and drive-shaft angular position sensor 28, an angular phase of drive shaft 6 relative to timing sprocket 30 is detected. Control-shaft angular position sensor 29 is provided to detect an angular position of control shaft 17. Airflow meter 08 is provided for measuring or detecting a quantity of air flowing through intake pipe I, and consequently for detecting or estimating the magnitude of engine load. The CPU of ECU 22 is responsible for carrying the control program stored in memories and is capable of performing necessary arithmetic and logic operations, for example, starter motor control performed by reversible starter motor 07, electronic throttle opening control achieved through the throttle actuator of electronically-controlled throttle valve unit SV, electronic fuel injection control achieved by the electronic fuel-injection system, electronic spark control achieved by the electronic ignition system, valve lift and working angle control executed by VEL mechanism 1, and phase control executed by VTC mechanism 2. Computational results (arithmetic calculation results), that is, calculated output signals are relayed through the output interface circuitry of ECU 22 to output stages, namely the throttle actuator of electronically-controlled throttle valve unit SV, electronically-controlled fuel injectors of the fuel-injection system, electronically-controlled spark plugs 05 of the electric ignition system, motor 20 of VEL mechanism 1, the solenoid of directional control valve 47 for VTC mechanism 2, and reversible starter motor (reversible cranking motor) 07 used for starter motor control.

Regarding VTC mechanism 2, by way of switching operation of directional control valve 47, working oil is supplied into variable-volume phase-advance chambers 41 for advancing intake valve closure timing IVC during an engine starting period. Thereafter, immediately when a desired cranking speed has been reached, by way of the switching operation of directional control valve 47, working oil is supplied into variable-volume phase-retard chambers 42 for retarding intake valve closure timing IVC.

Also provided is a lock mechanism (or an interlocking device or interlocking means) disposed between vane member 32 and housing 34, for disabling rotary motion of vane member 32 relative to housing 34 by locking and engaging vane member 32 with housing 34, and for enabling rotary motion of vane member 32 relative to housing 34 by unlocking (or disengaging) vane member 32 from housing 34. That is, as described later, by the interlocking means, intake valve closure timing IVC of each of intake valves 4, 4 can be locked or fixed to the predetermined timing value X(IVC) after TDC and before BDC on intake stroke (see FIG. 9).

As can be seen from the longitudinal cross section of FIG. 6, the lock mechanism (interlocking means) is comprised of a lock-pin sliding-motion permitting bore (simply, a lock-pin bore) 50, a lock pin 51, an engaging-hole structural member 52 having a substantially C shape in lateral cross section and press-fitted into a through hole formed in rear cover 36, an engaging hole 52*a* defined in the C-shaped engaging-hole structural member 52, a spring retainer 53, and a return spring (a coiled compression spring) 54. Lock-pin bore 50 is formed in the inverted trapezoidal blade 32*b* of the relatively greater circumferential width (the maximum circumferential width) and formed in rear cover 36, such that lock-pin bore 50 extends in the axial direction of drive shaft 6. Lock pin 51 is slidably accommodated in lock-pin bore 50 and has a cylindrical bore closed at one end. A tapered head portion 51*a* of lock pin 51 is engaged with or disengaged from engaging hole 52*a*. Spring retainer 53 is fitted into a space defined by the inner peripheral wall surface of front cover 35 and lock-pin bore 51. Return spring 54 is provided to permanently force lock pin 51 toward the internal space of engaging hole 52*a*. Although it is not clearly shown in FIG. 6, the phase-converter housing structure, constructed by front and rear covers 35-36 and cylindrical housing 34, is also designed to supply working oil (hydraulic pressure) in phase-retard chamber 42 and/or working oil (hydraulic pressure) discharged from oil pump 49 via an oil hole formed in the phase-converter housing structure into engaging hole 52*a*.

Lock pin 51 operates to disable relative rotation between timing sprocket 30 and drive shaft 6 by locking and engaging tapered head portion 51*a* of lock pin 51 with engaging hole 52*a* in a predetermined position where vane member 32 reaches its maximum phase-advance position, by way of the spring force of return spring 54. Relative rotation between timing sprocket 30 and drive shaft 6 is enabled by unlocking (or disengaging) tapered head portion 51*a* of lock pin 51 from engaging hole 52*a* by way of the hydraulic pressure delivered from phase-retard chamber 42 and/or oil pump 49 into engaging hole 52*a*. That is, tapered head portion 51*a* of lock pin 51 is forced out of engaging hole 52*a* under hydraulic pressure fed into the engaging hole from phase-retard chamber 42 and/or oil pump 49.

As previously described with reference to FIG. 7, two rows of return springs 55-56, each of which serves as a biasing device or biasing means, are disposed between the spring-retaining-hole equipped backward sidewall surface of blade 32*b* and the spring-retaining sidewall surface of shoe 34*a*, for permanently biasing the associated blade 32*b* (vane member 32) toward the phase-advance side. In the shown embodiment, return springs 55-56 are constructed by coil springs having the same size and the same spring stiffness.

Figure 8:
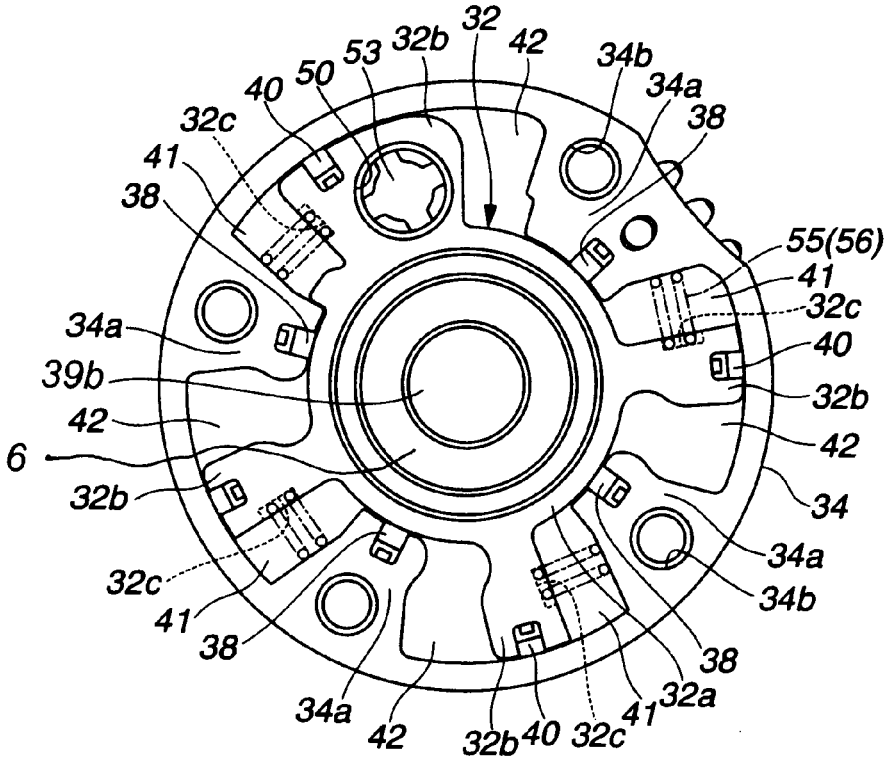
FIG. 8 is a lateral cross-section taken along the line A-A of FIG. 6, and showing the maximum phase-retard state of the VTC mechanism.

As shown in FIGS. 7-8, two return springs 55-56 are disposed in parallel with each other. As can be seen from the lateral cross section of FIG. 7, the axial length of each of springs 55-56 is dimensioned to be greater than the circumferential distance between the spring-retaining-hole equipped backward sidewall surface of blade 32*b* and the spring-retaining sidewall surface of shoe 34*a* with the blade 32*b* held at the maximum phase-advance position. Return springs (coil springs) 55-56 have the same free height.

The distance between the axes of two parallel coil springs 55-56 is preset to a predetermined distance that the outer peripheries of coil springs 55-56 are not brought into contact with each other under a condition of maximum compressive deformation of each of coil springs 55-56 (see FIG. 8). One end of each of coil springs 55-56, facing the associated blade 32*b*, is retained in a thin-plate spring retainer (not shown) fitted to concave groove (spring retaining hole) 32*c*.

Hereinafter described in detail is the operation of VTC mechanism 2, normally operating without any fault during an engine stopped period.

When the engine is shifted to a stopped state, the output of control current (exciting current) from ECU 22 to the solenoid of directional control valve 47 is also stopped. Thus, the valve spool of directional control valve 47 is shifted to its spring-offset position at which fluid communication between $1^{st}$ hydraulic line 43 and supply passage 45 is established, and simultaneously fluid communication between $2^{nd}$ hydraulic line 44 and drain passage 46 is established. Thus, vane member 32 tends to rotate towards the phase-advance side, but hydraulic pressure supplied from oil pump 49 and acting on blades 32*b* of vane member 32 becomes zero owing to a gradual fall in engine speed to essentially zero speed.

Under these conditions, as shown in FIG. 7, vane member 32 rotates clockwise, that is, in the rotation direction (indicated by the arrow in FIG. 7) of drive shaft 6, by way of the spring forces of return springs 55-56. Therefore, the inverted trapezoidal vane blade 32*b* of the maximum circumferential width is brought into abutted-engagement with the sidewall of shoe 34*a* facing phase-retard chamber 42. And thus, the relative phase between timing sprocket 30 and drive shaft 6 is changed to the maximum phase-advance side.

Figure 9:
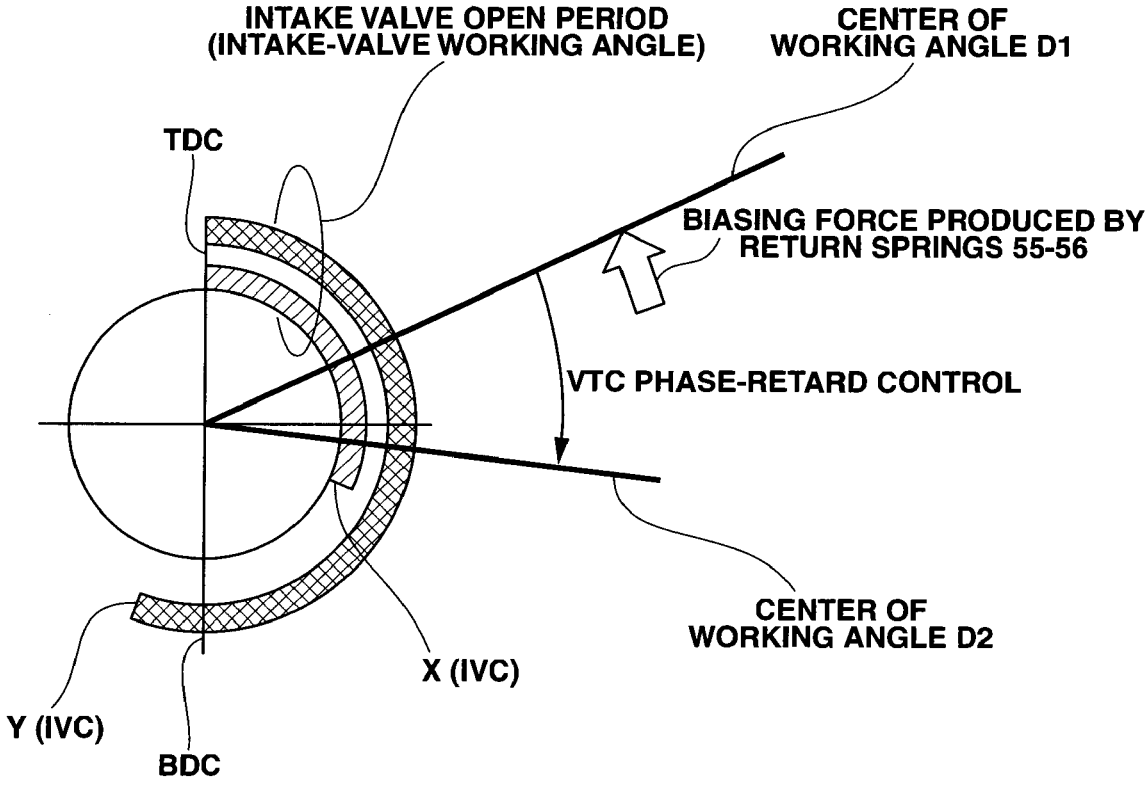
FIG. 9 is a characteristic diagram showing intake valve closure timing and intake valve open timing during a cranking period.

That is, with the inverted trapezoidal vane blade 32*b* forced into contact with shoe 34*b* by the spring forces of return springs 55-56, as shown in FIG. 9, according to phase control of VTC mechanism 2 combined with valve lift and working angle control (in other words, valve event and lift control) of VEL mechanism 1, intake valve closure timing IVC of each of two intake valves 4, 4 of the engine cylinder delivering its intake stroke, can be biased to a timing value after TDC (ATDC) and before BDC (BBDC) on intake stroke and located substantially at a midpoint of TDC and BDC (see the angular position indicated by "X(IVC)" in FIG. 9).

At the same time, tapered head portion 51*a* of lock pin 51 is brought into engagement with engaging hole 52*a* by the spring force of return spring 54, in such a manner as to disable relative rotation between timing sprocket 30 and drive shaft 6.

The previously-explained operation of VTC mechanism 2 corresponds to the normal (unfailed) VTC system operation during the engine stopped period. In contrast, suppose that a mechanical problem in directional control valve 47 of the VTC system, such as a sticking valve spool, takes place, and as a result the spool is stuck in the block-off position in which fluid communication between each of $1^{st}$ and $2^{nd}$ hydraulic lines 43-44 and each of supply and drain passages 45-46 is blocked. In the case of the spring-loaded four-blade rotary-vane type VTC mechanism shown in FIGS. 6-8, even with the spool stuck, vane member 32 is biased to the phase-advance side by way of the spring forces of return springs 55-56. Thus, in the failed VTC-system state (the malfunctioning VTC-system state) as well as in the unfailed VTC-system state (the normal VTC-system state), it is possible to switch the VTC mechanism to the maximum phase-advance position by virtue of the spring forces of return springs 55-56. The previously-noted lock mechanism or interlocking means (50, 51, 52, 52*a*, 53, 54) is advantageous or effective to certainly disable rotary motion of vane member 32 relative to housing 34 by locking and engaging vane member 32 in place by means of lock pin 51. As already discussed above, it is possible to temporarily shift the VTC mechanism to the maximum phase-advance position by the spring forces of return springs 55-56. Thus, for the purpose of lower VTC system costs and simplified VTC mechanism, the lock mechanism or interlocking means (50, 51, 52, 52*a*, 53, 54) may be eliminated. In contrast, for the purpose of high-precision VTC control, interlocking means may be provided in VEL mechanism 1 as well as VTC mechanism 2, for certainly reliably fixing intake valve closure timing (IVC) to the predetermined timing value X(IVC) of FIG. 9 to which intake valve closure timing (IVC) is permanently biased by the biasing device, that is, return springs 31, and 55-56.

Next, during an engine starting period, with the ignition switch turned ON, starter motor 07 is driven to initiate cranking operation for crankshaft 02. At such an early stage of cranking, intake valve closure timing IVC remains at a timing value before BDC and located substantially at the midpoint of TDC and BDC.

Upon expiration of the early stage of cranking, the solenoid of directional control valve 47 is shifted to its fully solenoid-actuated position responsively to a control signal from ECU 22 such that fluid communication between $2^{nd}$ hydraulic line 44 and supply passage 45 is established and fluid communication between $1^{st}$ hydraulic line 43 and drain passage 46 is established. Under these conditions, on the one hand, hydraulic pressure produced by oil pump 49 is supplied through supply passage 45 and $2^{nd}$ hydraulic line 44 into each of phase-retard chambers 42. On the other hand, there is no supply of hydraulic pressure to each of phase-advance chambers 41 in the same manner as the engine stopped state. That is, hydraulic pressure is relieved from each of phase-advance chambers 41 through $1^{st}$ hydraulic line 43 and drain passage 46 into oil pan 48 and thus the hydraulic pressure in each of phase-advance chambers 41 is kept low. Approximately at the same time, working fluid, supplied into phase-retard chamber 42, is also delivered from phase-retard chamber 42 into engaging hole 52*a*. As a result, lock pin 51 moves backwards against the spring bias of return spring 54 and then tapered head portion 51*a* of lock pin 51 is forced out of engaging hole 52*a*.

Therefore, vane member 32 is unlocked or disengaged from the stationary housing 34. Due to a rise in hydraulic pressure in phase-retard chamber 42, vane member 32 rotates counterclockwise (see FIG. 8) against the spring forces of return springs 55-56. This causes drive shaft 6 to rotate relative to timing sprocket 30 in the phase-retard side.

For the reasons discussed above, intake valve closure timing IVC is phase-retarded to a timing value near BDC to increase the effective compression ratio, thus ensuring good combustion. Furthermore, the intake-air charging efficiency can be enhanced, thus resulting in an increase in torque generated by combustion and consequently ensuring and realizing complete explosion and smooth engine speed rise.

Thereafter, the vehicle begins to run and engine warm-up further develops. As soon as a predetermined low engine speed range has been reached, the spool of directional control valve 47 is shifted to its spring-offset position responsively to a control signal from ECU 22, to establish fluid communication between $1^{St}$ hydraulic line 43 and supply passage 45 and fluid communication between $2^{nd}$ hydraulic line 44 and drain passage 46.

Therefore, hydraulic pressure in each of phase-retard chambers 42 is relieved through $2^{nd}$ hydraulic line 44 and drain passage 46 into oil pan 48 and thus the hydraulic pressure in each of phase-retard chambers 42 becomes low. Conversely, the hydraulic pressure in each of phase-advance chambers 41 becomes high.

Thus, owing to a rise in hydraulic pressure in phase-advance chamber 41 and spring forces of return springs 55-56, vane member 32 rotates clockwise. This causes drive shaft 6 to rotate relative to timing sprocket 30 in the phase-advance side. On the other hand, VEL mechanism 1 is controlled to a somewhat large intake-valve lift and working angle characteristic. Therefore, a valve overlapping period during which the intake and exhaust valves are both open, becomes great, thus resulting in a reduced pumping loss and improved fuel economy.

When shifting the engine operating condition from the low speed range to the middle speed range, and further shifting to the high speed range, as shown in FIG. 8, owing to a fall in hydraulic pressure supplied to phase-advance chamber 41 and a rise in hydraulic pressure in phase-retard chamber 42, vane member 32 rotates counterclockwise against the spring forces of return springs 55-56. As a result of this, the relative phase between timing sprocket 30 and drive shaft 6 is changed to the phase-retard side. By way of phase-retard control performed by VTC mechanism 2 combined with maximum intake-valve lift and maximum working angle control performed by VEL mechanism 1, it is possible to adequately phase-retard intake valve closure timing IVC, while ensuring some valve overlap, thus enhancing the fresh-air charging efficiency, and consequently ensuring the high engine power output.

Figure 10:
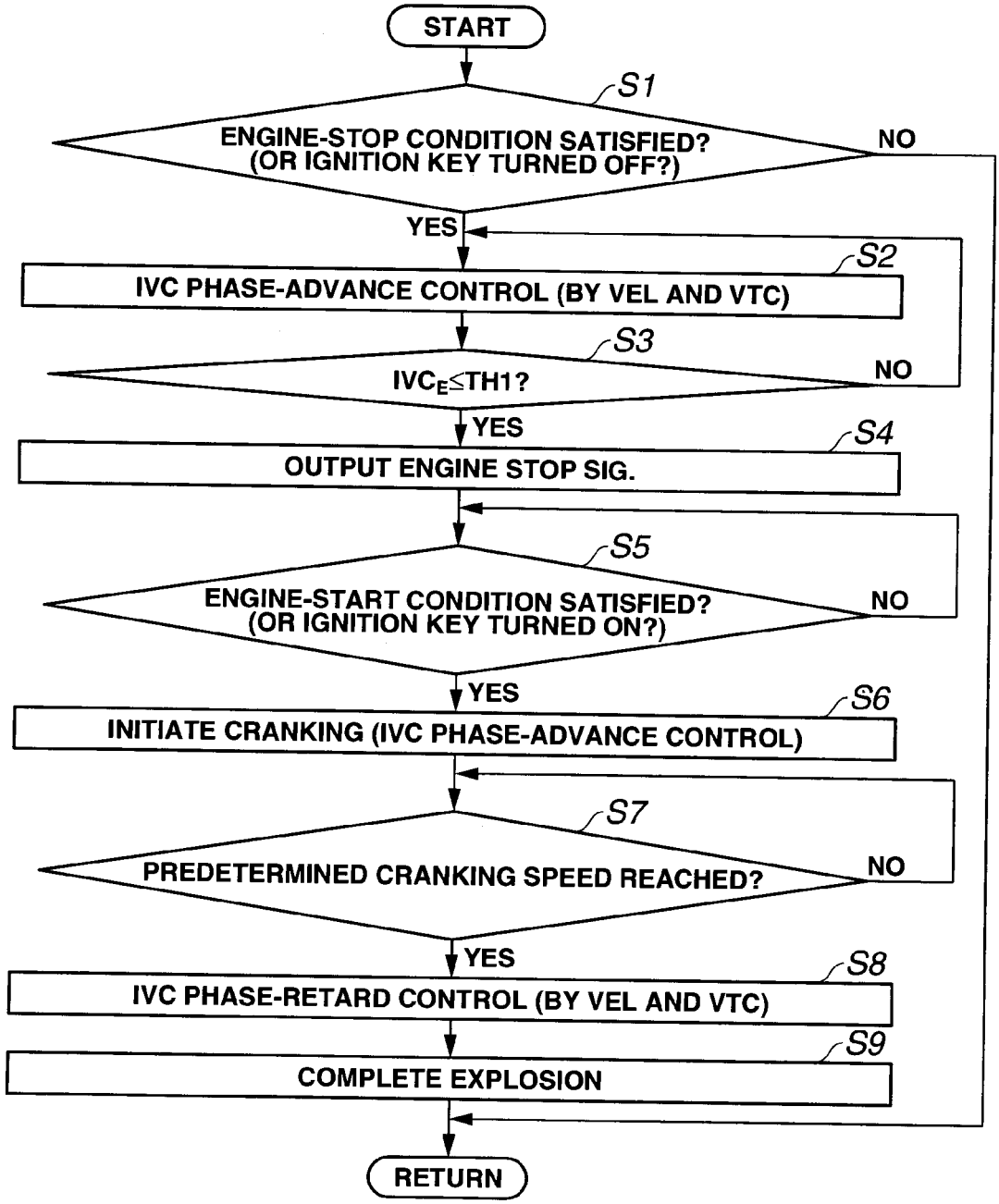
FIG. 10 is a flow chart showing a control routine executed within a controller incorporated in the variable valve actuation system of the embodiment.

Hereinbelow described in detail in reference to the flow chart of FIG. 10 is the concrete engine control routine executed within ECU 22 during the engine starting period. The control routine of FIG. 10 is executed as time-triggered interrupt routines to be triggered every predetermined time intervals such as 10 milliseconds.

At step S1, a check is made to determine whether an engine-stop condition, such as just before the engine is brought into its stopped state with the ignition switch (key switch) turned OFF, is satisfied. When the answer to step S1 is in the negative (NO), the routine returns to the first step S1. Conversely when the answer to step S1 is in the affirmative (YES), the routine proceeds from step S1 to step S2.

At step S2, according to IVC phase-advance control, performed by way of phase control of VTC mechanism 2 combined with valve lift and working angle control of VEL mechanism 1, intake valve closure timing IVC is advanced with respect to BDC and controlled to a timing value ATDC and BBDC on intake stroke and located substantially at a midpoint of TDC and BDC (see the angular position indicated by "X(IVC)" in FIG. 9 and corresponding to the maximum phase-advance position).

At step S3, a check is made to determine whether a deviation (i.e., an error signal value $IVC_E$) of the actual intake valve closure timing IVC obtained as a result of the phase-advance control of step S2 from a desired timing value is less than or equal to a predetermined threshold value TH1. When the answer to step S3 is negative (NO), that is, when the deviation is greater than the predetermined threshold value (i.e., $IVC_E$>TH1), the routine returns from step S3 to step S2, so as to re-execute phase-advance control. Conversely when the answer to step S3 is affirmative (YES), that is, when the deviation is less than or equal to the predetermined threshold value (i.e., $IVC_E \leqq$TH1), the routine advances from step S3 to step S4.

At step S4, ECU 22 outputs an engine stop signal for completely stopping the engine. After step S4, a series of steps S5-S9, suited to an engine starting period, occur.

At step S5, a check is made to determine whether an engine-start condition, such as the ignition switch turned to ON, is satisfied. When the answer to step S5 is negative (NO), that is, when the ignition switch remains turned OFF, the routine returns again to step S5. Conversely when the answer to step S5 is affirmative (YES), that is, just after the ignition switch has been switched to its turned-ON state, the routine advances from step S5 to step S6.

At step S6, cranking operation is initiated by driving crankshaft 02 by means of starter motor 07. More concretely, at the initial stage of step S6, the processor of ECU 22 recognizes or determines if the cranking operation is initiated with the intake valve closure timing IVC phase-advanced to the maximum phase-advance position, indicated by "X(IVC)" in FIG. 9, through steps S1-S3 just before the engine has been completely stopped. Assuming that the cranking operation is initiated at the intake valve closure timing IVC phase-advanced to the maximum phase-advance position, during the first one revolution of crankshaft 02 intake valve closure timing IVC remains kept at a timing value before BDC and located substantially at the midpoint of TDC and BDC. Thus, at the time when the piston passes BDC during the first one revolution of crankshaft 02, the in-cylinder pressure tends to become a negative pressure value lower than atmospheric pressure. When the crankshaft further revolves, the in-cylinder pressure is compressed to a pressure value slightly higher than the atmospheric pressure. Thus, the effective compression ratio becomes low, thereby causing the decompression state of the engine. Therefore, it is possible to adequately reduce noise and vibrations of the engine at the early stage of cranking. It is possible to promote a cranking speed rise at the early stage of cranking by way of the decompression effect. At the early stage of cranking, it is preferable to control intake valve open timing IVO to a timing value near TDC for the purpose of eliminating the valve overlapping period. On the other hand, at the early stage of cranking, intake valve closure timing IVC is controlled to the timing value before BDC. Therefore, it is possible to set the working angle of each of intake valves 4, 4 to the previously-noted small working angle D1 by virtue of VEL mechanism 1, thus effectively reducing the frictional loss of the valve operating system, and further promoting the cranking speed rise. This ensures the enhanced startability. In addition to the above, by virtue of the cranking speed rise effect, it is possible to efficiently reduce the load on starter motor 07. Furthermore, even when the spool of directional control valve 47 included in VTC mechanism 2 is stuck and/or even when comparatively great frictional resistances take place in VEL mechanism 1 owing to a friction against sliding motion of drive cam 7 within the drive-cam retaining bore of link arm 12, and (ii) a friction against sliding motion of control cam 18 within the rocker-arm center bore of rocker arm 11, it is possible to forcibly bias or shift intake valve closure timing IVC from BDC (the phase-retard side) to a timing value (the phase-advance side) near TDC by means of the spring bias of return springs 55-56 included in VTC mechanism 2 and/or the spring bias of return spring 31 included in VEL mechanism 1. As set forth above, it is possible to ensure the decompression effect. In other words, it is possible to provide a mechanical fail-safe effect by means of return spring 31 of VEL mechanism 1 and return springs 55-56 of VTC mechanism 2. When the processor of ECU 22 determines, at the beginning of the previously-noted cranking-initiation step S6, that intake valve closure timing IVC has not yet been advanced to the maximum phase-advance position indicated by "X(IVC)" in FIG. 9, before initiating cranking operation or during the initial cranking period, intake valve closure timing IVC is controlled to the maximum phase-advance position by phase-advance control performed by VEL and VTC mechanisms 1 and 2 combined with each other. Subsequently to step S6, step S7 occurs.

At step S7, a check is made to determine whether the latest up-to-date information about cranking speed reaches its desired speed value. That is, a test is made to determine if the more recent informational data about crankshaft revolutions per unit time reaches a predetermined cranking speed value. When the answer to step S7 is negative (NO), the routine returns again to step S7. Conversely when the answer to step S7 is affirmative (YES), the routine advances from step S7 to step S8.

At the point of time when shifting to step S8, by way of synergistic effect of the decompression effect and the low friction effect achieved by the previously-noted small lift and working angle characteristic, the cranking speed is speedily rising, while effectively suppressing or reducing undesired vibrations during cranking (during engine starting period).

At step S8, the working angle of each of intake valves 4, 4 is enlarged or increased by way of working-angle enlargement control performed by VEL mechanism 1. At the same time, by way of phase control performed by VTC mechanism 2, the angular phase of drive shaft 6 relative to crankshaft 02 is controlled to the phase-retard side. That is, by way of the IVC phase-retard control executed by the VEL and VTC mechanisms 1-2 combined with each other, intake valve closure timing IVC of each of intake valves 4, 4 can be rapidly controlled to the phase-retard side, and whereby intake valve closure timing IVC can be retarded to a timing value slightly passing the piston BDC position, that is, a timing value after and near BDC (see the angular position indicated by "Y(IVC)" in FIG. 9).

At step S9, fuel injection into each individual engine cylinder starts just after phase-retard control of intake valve closure timing IVC to the timing value indicated by "Y(IVC)" has been completed, and then the sprayed fuel is ignited. In this manner, a good complete explosion is achieved.

Suppose that intake valve closure timing IVC is fixed to the phase-advanced timing value suited to the early stage of cranking. In such a case, there is an increased tendency for combustion to be deteriorated when igniting the sprayed fuel owing to the comparatively low effective compression ratio, and thus it is impossible to generate sufficient torque (satisfactory driving torque) generated by combustion. In contrast, according to the variable valve actuation system of the embodiment, after a rapid cranking speed rise, intake valve closure timing IVC can be rapidly controlled to the phase-retard side (the timing value indicated by "Y(IVC)" in FIG. 9). Therefore, it is possible to control the effective compression ratio to high, thereby ensuring a good ignitability of fuel sprayed into the combustion chamber, and consequently shortening a complete-explosion time. Therefore, during the engine starting period from the beginning of cranking to the complete explosion, it is possible to enable the good startability, and thus to ensure sufficient driving torque. Additionally, during a cold engine start, it is possible to stably rotate the engine, thus ensuring sufficient driving torque (i.e., sufficient torque generated by combustion).

As set out above, according to the variable valve actuation system of the embodiment, at the early stage of cranking, intake valve closure timing IVC can be maintained at the timing value ATDC and BBDC on intake stroke and located substantially at the midpoint of TDC and BDC (see the angular position indicated by "X(IVC)" in FIG. 9) by means of VEL and VTC mechanisms 1-2 combined with each other. Thus, owing to a reduction in engine vibrations and a cranking speed rise, both attained by decompression during the initial cranking period, and owing to a reduction in valve-operating-system's friction and a further cranking speed rise, both attained by proper setting of intake-valve working angle to the small working angle D1 characteristic, it is possible to reconcile or balance two contradictory requirements, namely reduced engine noise/vibrations and enhanced startability (speedy cranking speed rise).

In particular, according to the system of the embodiment, VEL mechanism 1 is used together with VTC mechanism 2, and whereby it is possible to further approach or further phase-advance intake valve closure timing IVC toward the piston TDC position. Therefore, it is possible to more certainly realize or promote the starting-period noise/vibrations reduction effect and enhanced engine startability.

Additionally, according to the system of the shown embodiment, it is possible to lock vane member 32 of VTC mechanism 2 in place (e.g., the maximum phase-advance position) by the lock mechanism or interlocking means (50, 51, 52, 52*a*, 53, 54) in the engine stopped state. Thus, this effectively prevents or avoids unstable clockwise-and-counterclockwise motion (rattling motion) of vane member 32 arising from alternating torque during the engine starting period. As a result of this, it is possible to more certainly achieve both of reduced engine noise/vibrations during the engine starting period and enhanced startability.

Furthermore, according to the system of the embodiment, just after the predetermined cranking speed has been reached, the previously-described working angle enlargement control can be made to intake valves 4, 4 by means of VEL mechanism 1, thereby lengthening the intake valve open period. During the lengthened intake valve open period, the friction of the valve operating system tends to increase due to the valve spring force, but VTC mechanism 2 operates to bias intake valve closure timing IVC to the phase-retard side by virtue of the increased friction. This is because, due to an increase in the load (friction) against rotation, vane member 32 (inertia mass) tends to be left relative to timing sprocket 30. In particular, during the engine stopping period, there is an increased tendency for intake valve open timing IVO and intake valve closure timing IVC to be both retarded with respect to rotation of crankshaft 02 owing to the friction of the valve operating system and/or alternating torque acting on the camshaft. Thus, after the predetermined cranking speed has been reached, due to the increased friction of the valve operating system, the phase of vane member 32 (inertia mass) of VTC mechanism 2 can be adjusted toward the maximum phase-retard position. For the reasons discussed above, during an engine starting period it is possible to avoid a deterioration in responsiveness of phase control of VTC mechanism 2 toward the phase-retard side, which may occur owing to the spring forces of return springs 55-56 permanently forcing or biasing intake valve closure timing IVC to the phase-advance side.

Moreover, according to the system of the embodiment, even when the spool of directional control valve 47 included in VTC mechanism 2 is stuck, it is possible to forcibly bias or shift intake valve closure timing IVC from BDC (the phase-retard side) to the maximum phase-advance position indicated by "X(IVC)" in FIG. 9 by means of the spring bias of return springs 55-56 included in VTC mechanism 2. Thus, it is possible to more certainly provide the decompression effect achieved by such a mechanical fail-safe function (i.e., return springs 55-56).

Additionally, according to the system of the embodiment, VEL mechanism 1 is actuated by means of motor 20, whereas VTC mechanism 2 is actuated hydraulically. Thus, even when hydraulic pressure is not adequately risen during cranking (or at the early stage of cranking), the working angle of each of intake valves 4, 4 can be rapidly enlarged by means of the motor-driven VEL mechanism 1, and thus the friction of the valve operating system tends to immediately increase. As previously discussed, by virtue of the increased friction of the valve operating system, it is possible to improve the responsiveness of switching operation of the hydraulically-actuated VTC mechanism 2 to the phase-retard side. In the case of the variable valve actuation system of the embodiment employing VEL and VTC mechanisms 1-2 combined with each other, it is possible to ensure the adequately high responsiveness of phase-retard control of VTC mechanism 2.

The previously-described variable valve actuation system of the embodiment uses the hydraulically-actuated VTC mechanism. An angular phase of drive shaft 6 relative to timing sprocket, that is, a valve timing change of intake valve 4, may be achieved by using a hysteresis-brake equipped spiral-disk type VTC mechanism as disclosed in Japanese Patent Provisional Publication No. 2004-11537 (corresponding to U.S. Pat. No. 6,805,081), instead of using the hydraulically-actuated rotary vane type VTC mechanism. Regarding the detailed structure of the hysteresis-brake equipped spiral-disk type VTC mechanism, the teachings of U.S. Pat. No. 6,805,081 are hereby incorporated by reference. Briefly speaking, a relative phase-angle variator (relative phase varying means) is provided between a drive ring attached to timing sprocket 30 and driven by crankshaft 02 and a driven member fixedly connected to the front end of drive shaft 6, for varying an angular phase of drive shaft 6 (the driven member) relative to timing sprocket 30 (the drive ring). The relative phase-angle variator is comprised of a spiral disk and a motion-conversion linkage. The radial outside portion of the motion-conversion linkage is mechanically linked to both of timing sprocket 30 and the spiral disk, such that the radial outside portion of the linkage slides along a guide groove formed in timing sprocket 30 and also slides along a spiral guide groove formed in the spiral disk. On the other hand, the radial inside portion of the linkage is fixedly connected to drive shaft 6. When the phase angle of the spiral disk relative to timing sprocket 30 varies, the radial position of the outside portion of the linkage with respect to the axis of drive shaft 6 varies, and thus a phase change of drive shaft 6 relative to timing sprocket 30 occurs. To vary the phase angle of the spiral disk relative to drive shaft 6, a hysteresis brake is used. The braking action of the hysteresis brake of the spiral-disk type VTC mechanism with respect to the spiral disk is controlled in response to a control current, which is generated from ECU 22 and whose current value is properly adjusted or regulated depending on the latest up-to-date information about an engine/vehicle operating condition, such that a phase of intake valve 4, which is represented in terms of a crankangle, is properly controlled (phase-advanced or phase-retarded). That is, the spiral disk rotates substantially in synchronism with rotation of the timing sprocket. The angular position of the spiral disk relative to the timing sprocket can be controlled by means of the hysteresis brake depending on the engine/vehicle operating condition. In accordance with a change in the angular position of the spiral disk relative to the timing sprocket, the relative phase of drive shaft 6 to crankshaft 02 is controlled (advanced or retarded).

Therefore, in the case of the variable valve actuation system employing the hysteresis-brake equipped spiral-disk type VTC mechanism as well as the motor-driven VEL mechanism, the hysteresis-brake equipped spiral-disk type VTC mechanism does not include a return spring, as provided in the hydraulically-actuated VTC mechanism for forcibly biasing intake valve closure timing IVC to the maximum phase-advance position indicated by "X(IVC)" in FIG. 9 by means of the spring bias during a stopping period of the engine. Thus, instead of the return spring, the hysteresis-brake equipped spiral-disk type VTC mechanism is equipped with a spiral-disk stop-position control means (simply, stop control means) for stopping or locking the spiral disk at a predetermined angular position with respect to the timing sprocket just before the engine is brought into its stopped state. Also provided is a spiral-disk hold means, simply, hold means (in other words, IVC phase-hold means) for holding the spiral disk at the previously-noted predetermined angular position. The stop control means and hold means are constructed by an electric auxiliary brake. The auxiliary brake is interleaved between the timing sprocket and the spiral disk, and activated or deactivated in response to a control current generated from ECU 22. When the control current is high (ON), the auxiliary brake is activated to stop or hold rotation of the spiral disk relative to the timing sprocket. Conversely when the control current is low (OFF), the auxiliary brake is deactivated to permit rotation of the spiral disk relative to the timing sprocket. In this manner, the auxiliary brake is designed to hold or maintain intake valve closure timing IVC of each of intake valves 4, 4 at the maximum phase-advance position indicated by "X(IVC)" in FIG. 9 through the spiral disk.

Instead of using the auxiliary brake, a built-in stepping motor may be used as the stop control means and hold means. The built-in stepping motor is able to variably adjust the angular phase of the spiral disk relative to the timing sprocket.

Figure 11:
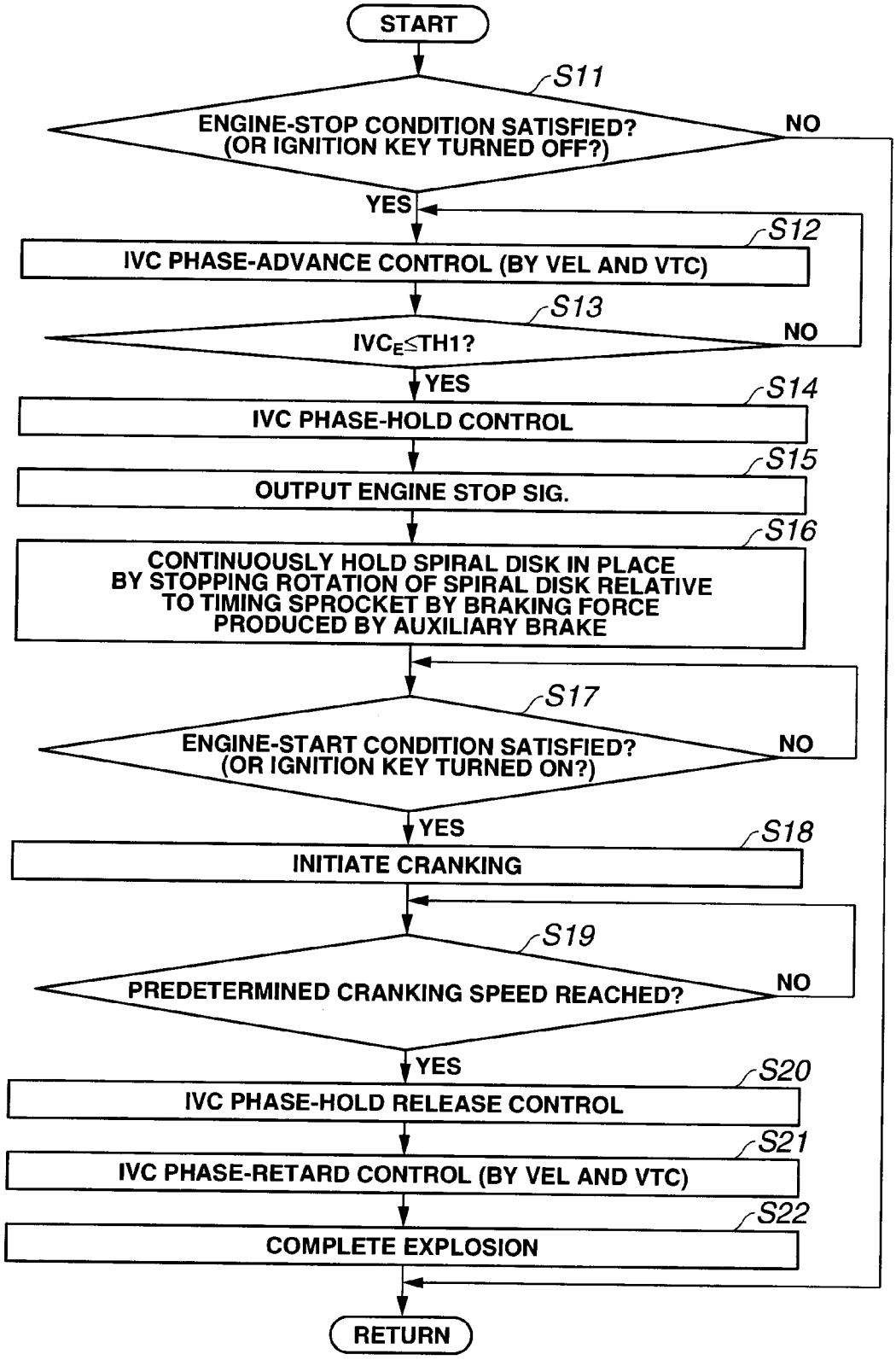
FIG. 11 is a flow chart showing a first modified control routine.

Hereinafter described in detail in reference to the flow chart of FIG. 11 is the first modified engine control routine executed within ECU 22 incorporated in the variable valve actuation system employing the hysteresis-brake equipped spiral-disk type VTC mechanism as well as the motor-driven VEL mechanism 1.

At step S11, a check is made to determine whether an engine-stop condition, such as just before the engine is brought into its stopped state with the ignition switch turned OFF, is satisfied. When the answer to step S11 is in the negative (NO), the routine returns to the first step S11. Conversely when the answer to step S11 is in the affirmative (YES), the routine proceeds from step S11 to step S12.

At step S12, according to IVC phase-advance control performed by way of phase control of the hysteresis-brake equipped spiral-disk type VTC mechanism combined with valve lift and working angle control of VEL mechanism 1, intake valve closure timing IVC is phase-advanced with respect to BDC and controlled to a timing value ATDC and BBDC on intake stroke and located substantially at the midpoint of TDC and BDC (see the angular position indicated by "X(IVC)" in FIG. 9 and corresponding to the maximum phase-advance position).

At step S13, a check is made to determine whether a deviation (i.e., an error signal value $IVC_E$) of the actual intake valve closure timing IVC obtained as a result of the phase-advance control of step S12 from a desired timing value is less than or equal to a predetermined threshold value TH1. When the answer to step S13 is negative (NO), that is, when the deviation is greater than the predetermined threshold value (i.e., $IVC_E$>TH1), the routine returns from step S13 to step S12, so as to re-execute phase-advance control. Conversely when the answer to step S13 is affirmative (YES), that is, when the deviation is less than or equal to the predetermined threshold value (i.e., $IVC_E \leqq$TH1), the routine advances from step S13 to step S14.

At step S14, for IVC phase-hold control, a braking force is applied to the spiral disk by means of the auxiliary brake of the hysteresis-brake equipped spiral-disk type VTC mechanism, for holding intake valve closure timing IVC at the maximum phase-advance position indicated by "X(IVC)" in FIG. 9 by holding the spiral disk at the predetermined angular position. On the other hand, VEL mechanism 1 is controlled to the minimum lift L1 and minimum working angle D1 characteristic by way of the spring bias of return spring 31.

At step S15, ECU 22 outputs an engine stop signal for completely stopping the engine.

At step S16, in order to continuously hold intake valve closure timing IVC at the predetermined timing value (that is, at the maximum phase-advance position indicated by "X(IVC)" in FIG. 9) during a time period from the time when the engine is stopped to the time when the engine is restarted, the auxiliary brake is activated to hold the spiral disk in place by stopping rotation of the spiral disk relative to the timing sprocket by the braking force produced by the auxiliary brake. After step S16, a series of steps S17-S22, suited to an engine starting period, occur.

At step S17, a check is made to determine whether an engine-start condition, such as the ignition switch turned to ON, is satisfied. When the answer to step S17 is negative (NO), that is, when the ignition switch remains turned OFF, the routine returns again to step S17. Conversely when the answer to step S17 is affirmative (YES), that is, just after the ignition switch has been switched to its turned-ON state, the routine advances from step S17 to step S18.

At step S18, cranking operation is initiated by driving crankshaft 02 by means of starter motor 07. More concretely, at the initial stage of step S18, the processor of ECU 22 recognizes or determines if the cranking operation is initiated at the intake valve closure timing IVC advanced to the maximum phase-advance position, indicated by "X(IVC)" in FIG. 9, just before the engine has been completely stopped. Assuming that the cranking operation is initiated at the intake valve closure timing IVC advanced to the maximum phase-advance position, during the first one revolution of crankshaft 02 intake valve closure timing IVC remains kept at a timing value before BDC and located substantially at the midpoint of TDC and BDC. Thus, at the time when the piston passes BDC during the first one revolution of crankshaft 02, the in-cylinder pressure tends to become a negative pressure value lower than atmospheric pressure. When the crankshaft further revolves, the in-cylinder pressure is compressed to a pressure value slightly higher than the atmospheric pressure. Thus, the effective compression ratio becomes low, thereby causing the decompression state of the engine. Therefore, it is possible to adequately reduce noise and vibrations of the engine at the early stage of cranking. It is possible to promote a cranking speed rise and effectively reduce the starting-period engine vibrations at the early stage of cranking by way of the decompression effect. Additionally, at the early stage of cranking, intake valve closure timing IVC is controlled to the timing value before BDC and located substantially at the midpoint of TDC and BDC. Therefore, it is possible to set the working angle of each of intake valves 4, 4 to the previously-noted small working angle D1 by virtue of VEL mechanism 1, thus effectively reducing the frictional loss of the valve operating system, and further promoting the cranking speed rise. This ensures the enhanced engine startability. In addition to the above, by virtue of the cranking speed rise effect, it is possible to efficiently reduce the load on starter motor 07. Subsequently to step S18, step S19 occurs.

At step S19, a check is made to determine whether the latest up-to-date information about cranking speed reaches its desired speed value. That is, a test is made to determine if the more recent informational data about crankshaft revolutions per unit time reaches a predetermined cranking speed value. When the answer to step S19 is negative (NO), the routine returns again to step S19. Conversely when the answer to step S19 is affirmative (YES), the routine advances from step S19 to step S20.

At step S20, for IVC phase-hold release control, auxiliary-brake-release processing is made to release the braking force applied to the spiral disk by the auxiliary brake of the hysteresis-brake equipped spiral-disk type VTC mechanism.

At step S21, the working angle of each of intake valves 4, 4 is enlarged or increased by way of working-angle enlargement control performed by VEL mechanism 1. At the same time, by controlling rotation of the spiral disk of the hysteresis-brake equipped spiral-disk type VTC mechanism by means of the hysteresis brake, the angular phase of drive shaft 6 relative to crankshaft 02 is controlled to the phase-retard side. That is, by way of the IVC phase-retard control executed by the VEL mechanism 1 and the hysteresis-brake equipped spiral-disk type VTC mechanism combined with each other, intake valve closure timing IVC can be rapidly controlled to the phase-retard side, and whereby intake valve closure timing IVC of each of intake valves 4, 4 can be retarded to a timing value slightly passing the piston BDC position, that is, a timing value after and near BDC (see the angular position indicated by "Y(IVC)" in FIG. 9).

At step S22, fuel injection into each individual engine cylinder starts just after phase-retard control of intake valve closure timing IVC to the timing value indicated by "Y(IVC)" has been completed, and then the sprayed fuel is ignited. In this manner, a good complete explosion is achieved. As discussed above, the variable valve actuation system of the first modification (see FIG. 11) employing the hysteresis-brake equipped spiral-disk type VTC mechanism as well as the motor-driven VEL mechanism 1 can provide the same effects as the variable valve actuation system of the embodiment (see FIGS. 1-10) employing the hydraulically-actuated rotary vane type VTC mechanism as well as the motor-driven VEL mechanism 1.

Additionally, during the engine starting period, it is possible to certainly hold intake valve closure timing IVC at the predetermined timing value by means of the auxiliary brake, thus avoiding unstable clockwise-and-counterclockwise motion (rattling motion) of the spiral disk arising from alternating torque acting on drive shaft 6, and consequently preventing unstable phase-control of the hysteresis-brake equipped spiral-disk type VTC mechanism.

According to the variable valve actuation system of the first modification (see FIG. 11) employing the hysteresis-brake equipped spiral-disk type VTC mechanism as well as the motor-driven VEL mechanism 1, the VTC phase of the VTC mechanism can be controlled by means of the hysteresis brake electrically rather than hydraulically. Additionally, in holding the angular position of the spiral disk relative to the timing sprocket at the predetermined position, the spiral disk is braked by means of the electric auxiliary brake. Even in the cold distinct or even in the arctic zone, regardless of the viscosity of working fluid, it is possible to easily reliably control intake valve closure timing IVC to the timing value before BDC and located substantially at the midpoint of TDC and BDC.

The inventive concept as set forth above can be applied to an internal combustion engine of a hybrid vehicle (HV) employing a parallel hybrid system using both of the engine and a motor generator (or an electric motor) as a driving power source for propulsion. In the case that the inventive concept can be applied to the engine of the hybrid vehicle, it is possible to provide the same operation and effects as the system of the embodiment shown in FIGS. 1-10 and the system of the first modification shown in FIG. 11, namely, reduced engine vibrations during cranking, a smooth cranking speed rise, a shortened complete-explosion time (rapid complete explosion), all contributing to enhanced startability. In engine stop-restart system equipped hybrid vehicles, frequently executing engine stop and restart operation, a merit in enhanced engine startability is very big. In such a hybrid vehicle, the restart operation is automatically initiated without depending on a driver's will. Thus, the engine noise/vibration reduction effect is very advantageous to eliminate any unnatural feeling that the driver experiences uncomfortable engine noise/vibrations during the engine restart operation. Additionally, in the case of a hybrid-vehicle engine, the engine can be cranked by means of a motor generator (an electric motor) rather than using a starter motor. Thus, it is possible to crank the engine crankshaft faster by the motor generator.

Also in the case of a hybrid vehicle employing a motor generator electrically connected to a car battery and enabling both a power running mode and a regenerative running mode, the motor generator serves, during the regenerative running mode for energy regeneration, as a generator that generates electricity by regenerative braking action and recharges the battery. During vehicle deceleration, it is possible to reduce engine braking by controlling intake valve closure timing IVC to the timing value after TDC (ATDC) and before BDC (BBDC) on intake stroke and located substantially at the midpoint of TDC and BDC (see the angular position indicated by "X(IVC)" in FIG. 9) by means of VEL and VTC mechanisms 1-2 combined with each other, thus ensuring the increased regenerative energy (regenerative electric power). As a result of this, it is possible to remarkably improve fuel economy of the hybrid vehicle.

As previously described, in controlling intake valve closure timing IVC to the timing value ATDC and BBDC on intake stroke and located substantially at the midpoint of TDC and BDC (see the angular position indicated by "X(IVC)" in FIG. 9) by means of VEL and VTC mechanisms 1-2, the variable valve actuation system of the embodiment is configured to stably bias intake valve closure timing IVC to the maximum phase-advance side by way of a mechanical fail-safe function created by return spring 31 of VEL mechanism 1 and return springs 55-56 of VTC mechanism 2, thus ensuring a high responsiveness of switching of intake valve closure timing IVC to the timing value ATDC and BBDC on intake stroke and located substantially at the midpoint of TDC and BDC (corresponding to the maximum phase-advanced position indicated by "X(IVC)" in FIG. 9). Therefore, it is possible to shorten a response time to a regenerative-braking starting point and to ensure improved fuel economy.

Additionally, according to the system of the embodiment, intake valve closure timing suited to a vehicle deceleration period can be set to be substantially identical to intake valve closure timing suited to either one of the engine starting period and the engine stopping period. By such IVC setting for the vehicle decelerating period, it is possible to keep intake valve closure timing IVC at an essentially constant timing value, irrespective of the responsiveness of operation of VEL mechanism 1 and the responsiveness of operation of VTC mechanism 2, and irrespective of the time period from the time when the vehicle begins to decelerate to the time when the engine has been completely stopped. Thus, during the engine stopping period, it is possible to effectively suppress or minimize undesirable fluctuations in intake valve closure timing IVC, thus ensuring the stable startability of the engine.

Furthermore, during the engine stopping period, the processor of ECU 22 may be configured to control the angular phase of crankshaft 02 by means of the motor generator (also serving as a large-torque-capacity cranking motor) of the hybrid vehicle in such a manner as to completely stop the engine at a phase (or at a crankangle of crankshaft 02) that intake valves 4, 4 open.

At the early stage of cranking, the in-cylinder pressure becomes an atmospheric pressure during a period of time where intake valves 4, 4 open. Thereafter, at the point of time when intake valves 4, 4 close, that is, at intake valve closure timing, the in-cylinder pressure remains kept at an approximately atmospheric pressure. In accordance with a further downstroke of the piston from the intake valve closure timing, the in-cylinder pressure further falls. Thus, when cranking the engine, the compression of air-fuel mixture becomes stable. Although it may be hard to be usually generated, assuming that the engine has been stopped at a crankangle (at an angular phase of crankshaft 02) after intake valve closure timing IVC, intake valves 4, 4 are kept closed, that is, at the beginning of compression stroke. Under these conditions, that is, with the engine stopped at the angular phase of crankshaft 02 that intake valves 4, 4 close, due to a gradual flow of atmosphere into the engine cylinders, with the lapse of time, the in-cylinder pressure of each individual engine cylinder becomes the atmospheric pressure. Therefore, the in-cylinder pressure remains kept at the approximately atmospheric pressure at the beginning of the engine restarting period. In the case that cranking operation is initiated under the in-cylinder pressure kept substantially at atmospheric pressure, owing to fluctuations in the initial angular phase of crankshaft 02, the compression of air-fuel mixture at TDC on compression stroke tends to become excessive or fluctuate. This leads to the problem of instable engine startability. In contrast, by way of the previously-discussed crankshaft stopping angular position control according to which the angular phase of crankshaft 02 is controlled to a predetermined crankangle that intake valves 4, 4 open, it is possible to avoid the aforementioned problem.

Figure 12:
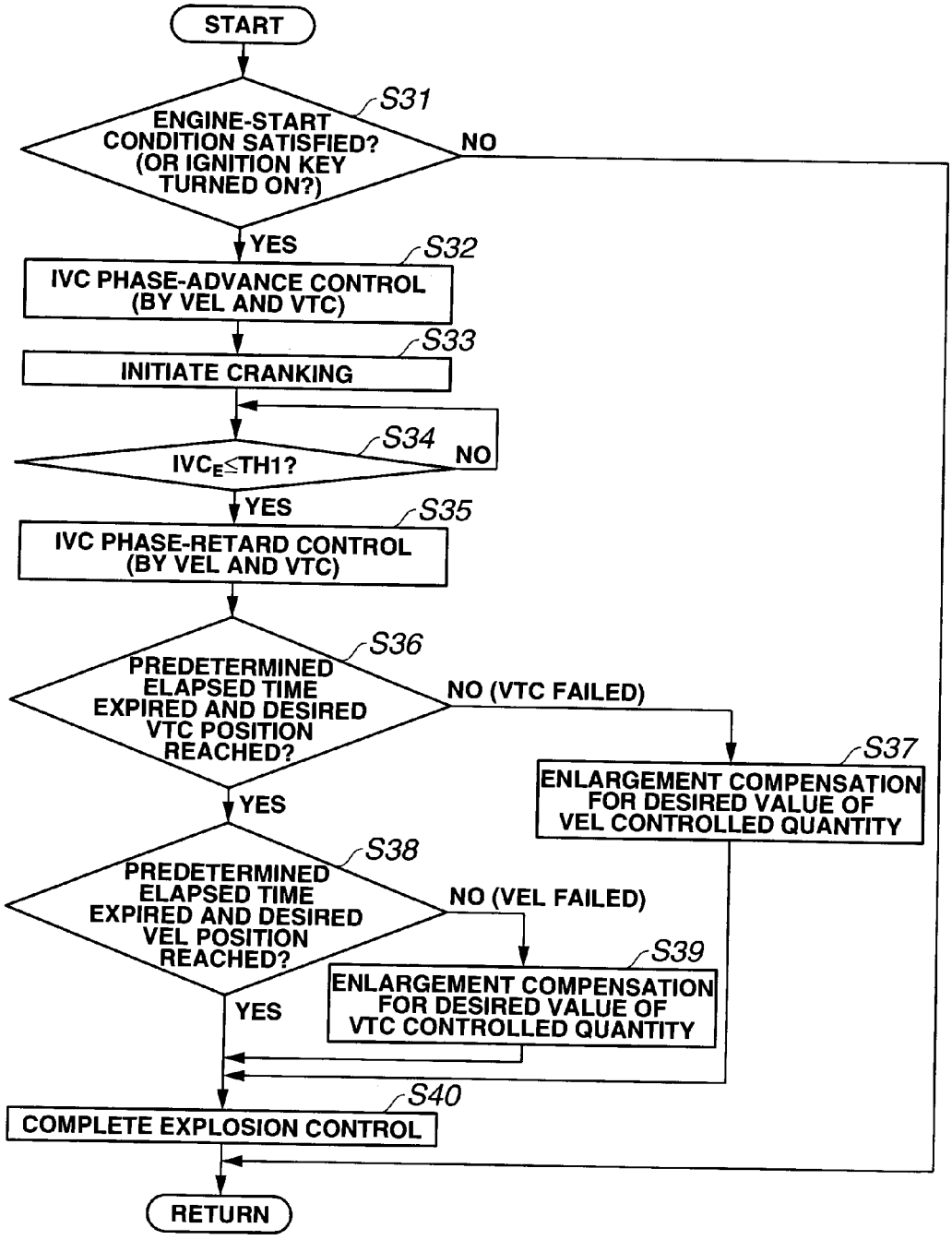
FIG. 12 is a flow chart showing a second modified control routine.

Referring now to FIG. 12, there is shown the second modified engine control routine executed within ECU 22 incorporated in the variable valve actuation system employing VEL and VTC mechanisms 1-2, fully taking account of the presence or absence of a fault in either one of VEL and VTC mechanisms 1-2. Even when a failure in either one of VEL and VTC mechanisms 1-2 occurs during IVC phase control wherein intake valve closure timing is changing to the phase-retard side after the predetermined cranking speed has been reached, the system can execute the second modified routine of FIG. 12 according to which intake valve closure timing IVC can be reliably controlled to the phase-retard side by means of the unfailed mechanism of VEL and VTC mechanisms 1-2.

In the case of the variable valve actuation system capable of executing the second modified routine of FIG. 12, it is possible to control intake valve closure timing IVC to the phase-retard side by means of the unfailed mechanism of VEL and VTC mechanisms 1-2, thus ensuring the shortened complete-explosion time.

Furthermore, in controlling intake valve closure timing IVC to the phase-retard side by means of the unfailed mechanism of VEL and VTC mechanisms 1-2, it is possible to increasingly compensate for a desired value of a controlled quantity of phase-retard control performed by the unfailed mechanism, as compared to a normal desired value preset or preprogrammed for the unfailed mechanism. By virtue of the properly compensated desired value of phase-retard control performed by only the unfailed mechanism, the actual phase-retard amount of intake valve closure timing can be approached closer to the total IVC phase-retard amount performed by VEL and VTC mechanisms both operating normally. Thus, it is possible to enhance the engine startability, obtained when a failure in either one of VEL and VTC mechanisms 1-2 occurs, up to that obtained when VEL and VTC mechanisms 1-2 are both operating normally, during an engine starting period from a starting point of cranking to a complete explosion. Hereinbelow described in detail in reference to the flow chart of FIG. 12 is the second modified engine control routine, fully taking into account a countermeasure against the presence of a failure in either one of VEL and VTC mechanisms 1-2.

At step S31, a check is made to determine whether an engine-start condition, such as just before the engine is brought into its starting state with the ignition switch turned ON, is satisfied. When the answer to step S31 is negative (NO), the routine returns to the first step S31. Conversely when the answer to step S31 is affirmative (YES), the routine proceeds from step S31 to step S32.

At step S32, according to IVC phase-advance control performed by phase-advance control of VTC mechanism 2 combined with small valve lift and small working angle control of VEL mechanism 1, intake valve closure timing IVC is advanced with respect to BDC and controlled to a timing value before BDC and located substantially at a midpoint of TDC and BDC. By virtue of the spring bias of return spring 31 included in VEL mechanism 1 and the spring bias of return springs 55-56 included in VTC mechanism 2, intake valve closure timing IVC can be stably biased toward the predetermined angular position indicated by "X(IVC)" in FIG. 9 and corresponding to the maximum phase-advance position). Thus, it is possible to realize easy and quick IVC phase-advance control.

At step S33, cranking operation is initiated by driving crankshaft 02 by means of starter motor 07, and then cranking speed tends to speedily rise owing to the previously-noted decompression effect and the low frictional loss effect created by the small intake valve lift and small working angle.

At step S34, a check is made to determine whether the latest up-to-date information about cranking speed reaches its desired speed value. That is, a test is made to determine if the more recent informational data about crankshaft revolutions per unit time reaches a predetermined cranking speed value. When the answer to step S34 is negative (NO), the routine returns again to step S34. Conversely when the answer to step S34 is affirmative (YES), the routine advances from step S34 to step S35.

At step S35, VEL and VTC mechanisms 1-2 are both operated in a manner so as to control intake valve closure timing IVC to a timing value after and near BDC (see the angular position indicated by "Y(IVC)" in FIG. 9).

At step S36, a check is made to determine whether a desired phase-retard position of VTC mechanism 2 has been reached after a predetermined elapsed time (predetermined time period), counted from a starting point of phase-retard control of VTC mechanism 2. When the answer to step S36 is negative (NO), the processor of ECU 22 determines that a failure in VTC mechanism 2 (i.e., a VTC system failure) occurs, and thus the routine proceeds from step S36 to step S37. Conversely when the answer to step S36 is affirmative (YES), that is, when the processor of ECU 22 determines that VTC mechanism 2 is unfailed (operating normally), the routine advances from step S36 to step S38.

At step S37, the desired valve lift L and working angle D characteristic of VEL mechanism 1 (unfailed one of VEL and VTC mechanisms 1-2) is increasingly compensated for, so that the desired working angle is set to a working angle greater than the middle working angle D2 for adjusting intake valve closure timing IVC to a timing value substantially corresponding to the angular position indicated by "Y(IVC)" in FIG. 9 by means of only the unfailed VEL mechanism 1.

At step S38, a check is made to determine whether a desired working angle D2 of VEL mechanism 1 has been reached after a predetermined elapsed time, counted from a starting point of valve lift and event control (concretely, working-angle enlargement control) of VEL mechanism 1. When the answer to step S38 is negative (NO), the processor of ECU 22 determines that a failure in VEL mechanism 1 (i.e., a VEL system failure) occurs, and thus the routine proceeds from step S38 to step S39. Conversely when the answer to step S38 is affirmative (YES), that is, when the processor of ECU 22 determines that VEL mechanism 1 is unfailed (operating normally), the routine advances from step S38 to step S40.

At step S39, the desired phase retard amount of VTC mechanism 2 (unfailed one of VEL and VTC mechanisms 1-2) is increasingly compensated for, so that the desired phase-conversion angle to the phase-retard side is increased for adjusting intake valve closure timing IVC to a timing value substantially corresponding to the angular position indicated by "Y(IVC)" in FIG. 9 by means of only the unfailed VTC mechanism 2.

At step S40, for complete explosion control, fuel injection and ignition timing are electronically controlled by means of the electronic fuel injection system and the electronic ignition system. At the point of time when step S40 starts, intake valve closure timing IVC has already been controlled to the desired timing value indicated by "Y(IVC)" in FIG. 9, and thus, the intake-air charging efficiency becomes high. Therefore, it is possible to realize a good complete explosion.

In the shown embodiment, as variable valve actuation means, variable valve event and lift (VEL) mechanism 1 and variable valve timing control (VTC) mechanism 2 are both used. It is not always necessary to use both of VEL and VTC mechanisms 1-2. Intake valve closure timing IVC and intake valve open timing IVO may be varied by either one of VEL and VTC mechanisms 1-2. Although VEL mechanism 1 is used as a variable valve lift mechanism, in lieu thereof another type of variable valve lift mechanism, such as a two-step or multi-step variable valve lift (VVL) mechanism, may be utilized. Although the hydraulically-actuated rotary vane type VTC mechanism or the hysteresis-brake equipped spiral-disk type VTC mechanism is used as a variable valve timing control mechanism, in lieu thereof another type of phase control mechanism, such as an axially movable helical gear type VTC mechanism may be utilized.

As can be appreciated from the valve-clearance line and phase-advanced valve closure timing value P1 shown in FIG. 5, in the shown embodiment intake valve closure timing IVC of each of intake valves 4, 4 is defined as a position at which the intake valve seats. Alternatively, intake valve closure timing IVC may be defined as the really effective closure timing, for example, an ending point of the lift surface area except the moderately sloped ramp surface area. In the ramp surface area, the gas flow rate is adequately small. From the viewpoint of the effective intake valve closure timing, the ramp surface area is negligible.

The entire contents of Japanese Patent Application Nos. 2006-247523 (filed Sep. 13, 2006) and 2005-377011 (filed Dec. 28, 2005) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A control system of a variable valve actuation system employing a variable valve actuation device for variably adjusting a working angle of an intake valve of an internal combustion engine and an electric motor for changing the working angle by actuating the variable valve actuation device depending on engine operating conditions, the control system comprising:

a desired value setting section configured to set a desired value of the working angle of the intake valve to a working angle value having a predetermined valve open period suited to an engine-stopping period after an engine-stop signal for the engine has been outputted;

a working-angle decision section configured to determine whether the desired working angle value has been reached;

a stop processing section configured to execute engine-stop processing to stop the engine when the desired working angle value has been reached;

an engine-speed decision section configured to determine whether a predetermined cranking speed of the engine has been reached after an engine-restart signal has been outputted after the engine has been stopped via the engine-stop processing; and a working-angle enlargement section configured to enlarge the working angle of the intake valve to a working angle value greater than the desired working angle value suited to the engine-stopping period when the predetermined cranking speed has been reached.

2. The control system of the variable valve actuation system as claimed in claim 1, wherein the working-angle decision section is configured to determine that the desired working angle value has been reached when a deviation between a current value of the working angle and the desired working angle value is less than or equal to a predetermined threshold value.

3. A control system of a variable valve actuation system employing a variable valve actuation device for continuously variably adjusting a lift amount of an intake valve of an internal combustion engine and an electric motor for changing the lift amount by actuating the variable valve actuation device depending on engine operating conditions, the control system comprising:

a processor programmed to:

drive the electric motor to bring the lift amount of the intake valve closer to a desired lift amount suited to an engine-stopping period after an engine-stop signal for the engine has been outputted;

execute engine-stop processing to stop the engine when the desired lift amount of the intake valve has been reached; and drive the electric motor to further enlarge the lift amount of the intake valve from the desired lift amount suited to the engine-stopping period when a predetermined cranking speed of the engine has been reached after an engine-restart signal has been outputted after the engine has been stopped via the engine-stop processing.

* * * * *